US011385580B2

(12) United States Patent
Endo

(10) Patent No.: US 11,385,580 B2
(45) Date of Patent: Jul. 12, 2022

(54) IMAGE FORMING APPARATUS WITH HEATING DEVICE, HEATING DEVICE WITH FIXING BELT, AND HEATING CONTROL METHOD FOR HEATING DEVICE

(71) Applicant: TOSHIBA TEC KABUSHIKI KAISHA, Tokyo (JP)

(72) Inventor: Sasuke Endo, Chigasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/336,064

(22) Filed: Jun. 1, 2021

(65) Prior Publication Data

US 2022/0035277 A1 Feb. 3, 2022

(30) Foreign Application Priority Data

Aug. 3, 2020 (JP) ..... JP2020-131826

(51) Int. Cl.
*G03G 15/20* (2006.01)

(52) U.S. Cl.
CPC ..... *G03G 15/205* (2013.01); *G03G 15/2017* (2013.01); *G03G 2215/2016* (2013.01); *G03G 2215/2035* (2013.01)

(58) Field of Classification Search
CPC ..... G03G 15/20; G03G 15/2014; G03G 15/2017; G03G 15/2064; G03G 2215/2016; G03G 2215/2035
USPC ..... 399/33, 67, 329; 219/216
See application file for complete search history.

(56) References Cited

U.S. PATENT DOCUMENTS

2012/0183312 A1* 7/2012 Choi ..... G03G 15/205 399/33
2020/0073301 A1* 3/2020 Sakai ..... G03G 15/55

FOREIGN PATENT DOCUMENTS

| | | | |
|---|---|---|---|
| JP | 2003029555 A | * | 1/2003 |
| JP | 2007206204 A | * | 8/2007 |
| JP | 2009122499 A | | 6/2009 |
| JP | 2014219585 A | * | 11/2014 |
| JP | 2016212209 A | | 12/2016 |
| JP | 2017040801 A | | 2/2017 |
| JP | 2017090784 A | | 5/2017 |
| JP | 2017138427 A | * | 8/2017 |

* cited by examiner

*Primary Examiner* — Robert B Beatty
(74) *Attorney, Agent, or Firm* — Kim & Stewart LLP

(57) ABSTRACT

According to one embodiment, a heating device includes a fixing belt configured to be rotated and a pressure roller configured to abut against the fixing belt and be driven to cause the fixing belt to rotate. A heater is configured to heat the fixing belt. A motor is configured to drive the pressure roller to rotate. A current sensor is configured to measure a driving current of the motor. A controller is configured to stop the heater based on the measured driving current.

11 Claims, 12 Drawing Sheets

IMAGE FORMING APPARATUS WITH HEATING DEVICE, HEATING DEVICE WITH FIXING BELT, AND HEATING CONTROL METHOD FOR HEATING DEVICE

CROSS-REFERENCE TO RELATED APPLICATION

This application is based upon and claims the benefit of priority from Japanese Patent Application No. 2020-131826, filed Aug. 3, 2020, the entire contents of which are incorporated herein by reference.

FIELD

Embodiments described herein relate generally to a heating device and a heating control method.

BACKGROUND

There are on-demand heating devices such as film-type fixing devices. An on-demand heating device can be installed in an image forming apparatus, such as a multi-function peripheral (MFP). In a conventional on-demand heating device, a fixing belt (tubular or cylindrical film) supported so as to rotate with the rotation of a pressure roller which abuts against the fixing belt. A lubricant is applied to be between a sliding surface of the fixing belt and a belt support section that supports the inner peripheral surface of the fixing belt as it rotates. As the fixing belt rotates, the amount of lubricant gradually decreases over time, and the decrease in amount of lubricant makes it more difficult to rotate the fixing belt. However, there is a technology of the related art that detects that the amount of lubricant decrease by detecting an increase in the load torque of a drive motor that rotates the pressure roller, and issues an alarm when the lubricant amount appears to be low.

In an on-demand heating device, when the rotation of the fixing belt stops, there is a case where the temperature in the vicinity of the heating section that is used to heat the fixing belt will rise rapidly. This is due to the fact that, when the fixing belt stops rotating, paper is not being fed between the fixing belt and the pressure roller, and the heat in the vicinity of the heating section is no longer taken away by the paper. The rotation of the fixing belt usually stops due to a decrease in residual amount of lubricant or a poor abutment between the fixing belt and the pressure roller. When the temperature in the vicinity of the heating section rises rapidly, there can be a case where the fixing belt or the like is damaged.

In the technology in the related art, there is a possibility that the temperature of the fixing belt near the heating section will reach a damaging temperature when the increase in load torque of the drive motor is detected. In the related art, it is also not possible to detect the stop of rotation of the fixing belt caused by poor abutment between the fixing belt and the pressure roller. Thus, in the related art, there can be a problem that a rapid rise in temperature in the vicinity of the heating section damages the components.

DETAILED DESCRIPTION

At least one embodiment of the present disclosure prevents potential damage to equipment that might be caused by a rapid temperature rise of a heating section.

According to one embodiment, a heating device includes a fixing belt be rotated and a pressure roller to abut against the fixing belt. The pressure roller is configured to be driven to rotate by a motor to cause the fixing belt to rotate. A heater is configured to heat the fixing belt. A current sensor is configured to measure a driving current of the motor. A controller is configured to stop the heating of the heater based on the measured driving current.

Hereinafter, a heating device and a heating control method according to certain example embodiments will be described with reference to the drawings.

First Embodiment

Figure 1:
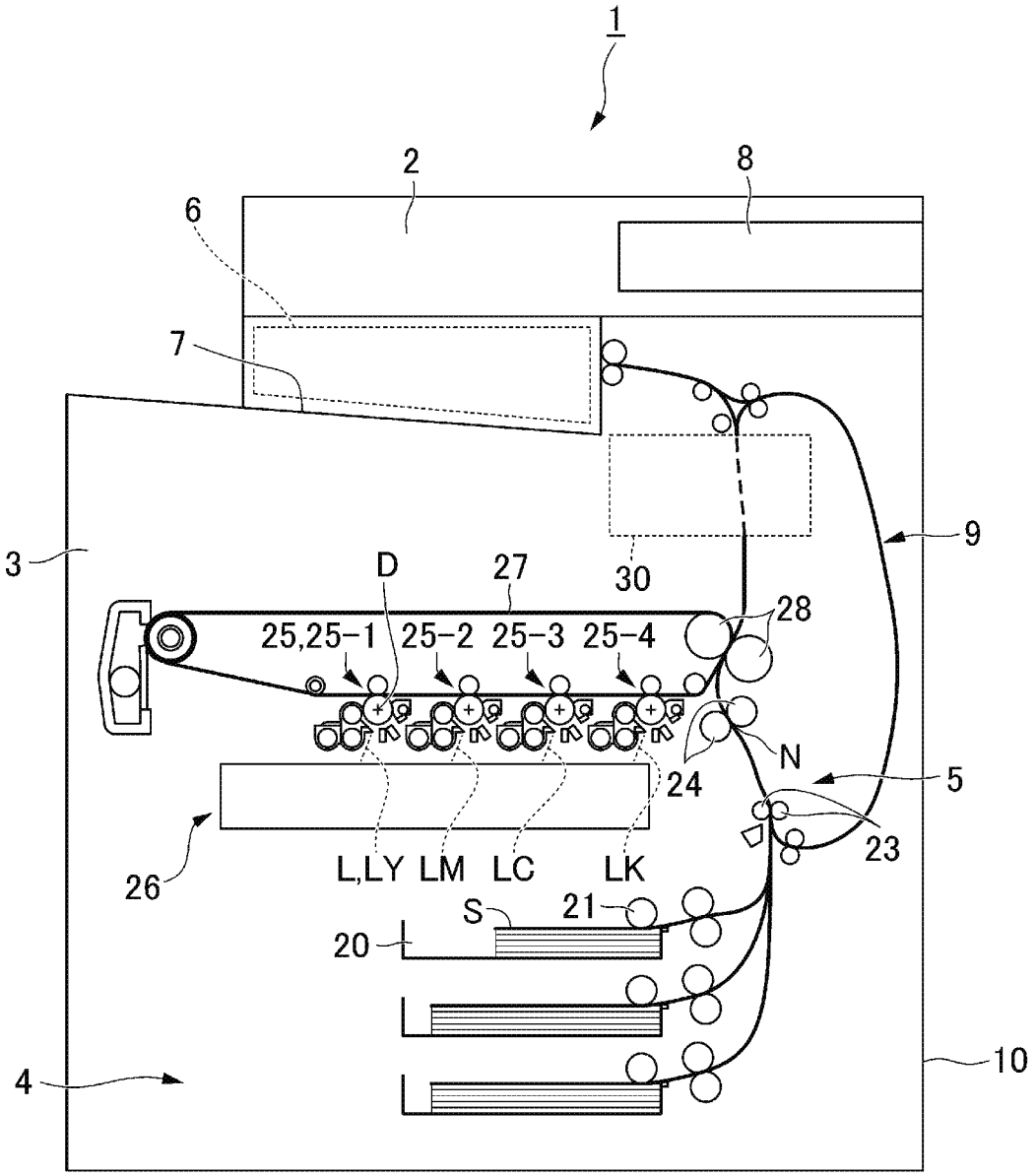
FIG. 1 is a schematic configuration of an image processing apparatus in a first embodiment.

FIG. 1 is a schematic configuration view of an image processing apparatus in a first embodiment.

The image processing apparatus in the first embodiment is an image forming apparatus 1. The image forming apparatus 1 performs processing for forming an image on a sheet S. The sheet S is, for example, paper or label paper. The sheet S may be any type of sheet as long as the image forming apparatus 1 can form an image on the front surface thereof.

The image forming apparatus 1 includes a housing 10, a scanner section 2, an image forming unit 3, a sheet supply section 4, a conveying section 5, a paper discharge tray 7, a reversing unit 9, a control panel 8, and a control section 6.

The housing 10 forms an outer shape of the image forming apparatus 1.

The scanner section 2 reads image information of a copy target based on brightness and darkness of light and generates an image signal accordingly. The scanner section 2 outputs the generated image signal to the image forming unit 3.

The image forming unit 3 forms an image with a recording material such as toner based on an image signal input from the scanner section 2 or an image signal input from the outside (e.g., an external device). The image formed initially by the image forming unit 3 is referred to as a toner image. The image forming unit 3 transfers the toner image to a surface of the sheet S. The image forming unit 3 heats and presses the toner image transferred to the front surface of the sheet S to fix the toner image to the sheet S. The details of the image forming unit 3 will be described later.

The sheet supply section 4 supplies the sheets S one by one to the conveying section 5 to be synchronized with the image forming unit 3 that forms a toner image for the sheet S. The sheet supply section 4 includes a sheet accommodation section 20 and a pickup roller 21.

The sheet accommodation section 20 stores the sheets S of a predetermined size and type.

The pickup roller 21 takes out the sheets S one by one from the sheet accommodation section 20. The pickup roller 21 supplies the taken-out sheet S to the conveying section 5.

The sheet S on which the image can be formed may be a sheet accommodated in the sheet accommodation section 20 or may be a sheet manually inserted into the image forming apparatus 1.

The conveying section 5 conveys the sheet S from the sheet supply section 4 to the image forming unit 3. The conveying section 5 has a conveying roller pair 23 and a registration roller pair 24.

The conveying roller pair 23 conveys the sheet S supplied from the pickup roller 21 to the registration roller pair 24. The conveying roller pair 23 makes the leading end of the sheet S abut against a nip of the registration roller pair 24.

The registration roller pair 24 holds the sheet S at the nip to adjust the position of the leading end of the sheet S in the conveying direction. The registration roller pair 24 conveys the sheet S according to the timing at which the image forming unit 3 can appropriately transfer the toner image to the sheet S.

The image forming unit 3 includes a plurality of image forming sections 25 (25-1, 25-2, 25-3, 25-4), a laser scanning unit 26, an intermediate transfer belt 27, a transfer section 28, and a fixing device 30.

Each image forming section 25 has a photoreceptor drum D. Each image forming section 25 forms a toner image corresponding to the image signal from the scanner section 2 or the outside, on the respective photoreceptor drum D. The image forming sections 25-1, 25-2, 25-3, and 25-4 form toner images with yellow, magenta, cyan, and black toners, respectively.

An electrostatic charging device, a developing device, and the like are disposed around each photoreceptor drum D. The electrostatic charging device electrostatically charges the surface of the photoreceptor drum D. The developing device contains a developer with one of the yellow, magenta, cyan, or black color toners. The developing device supplies toner that develops the electrostatic latent image on the photoreceptor drum D. As a result, a toner image made by toner of a color is formed on the photoreceptor drum D.

The laser scanning unit 26 selectively scans the charged photoreceptor drum D with a laser beam L to expose the photoreceptor drum D according to the image signal. The laser scanning unit 26 exposes the photoreceptor drum D of the image forming sections 25-1, 25-2, 25-3, and 25-4 with different laser beams (laser beams LY, LM, LC, and LK). Accordingly, the laser scanning unit 26 forms an electrostatic latent image on each photoreceptor drum D.

The toner image on the surface of the photoreceptor drum D is transferred to the intermediate transfer belt 27 (referred to as a primary transfer).

The transfer section 28 transfers the toner image primarily transferred onto the intermediate transfer belt 27, onto the front surface of the sheet S at a secondary transfer position.

The fixing device 30 heats and presses the toner image transferred to the sheet S to fix the toner image to the sheet S.

The reversing unit 9 reverses the sheet S to form an image on the back surface of the sheet S. The reversing unit 9 reverses the sheet S discharged from the fixing device 30 upside down by switchback. The reversing unit 9 conveys the reversed sheet S back toward the registration roller pair 24.

The sheet S on which the image is formed is discharged and placed on the paper discharge tray 7.

The control panel 8 is a part of an input section through which an operator inputs information for operating the image forming apparatus 1. The control panel 8 has a touch panel and various hard keys.

The control section 6 controls each member of the image forming apparatus 1. Details of the control section 6 will be described later.

Figure 2:
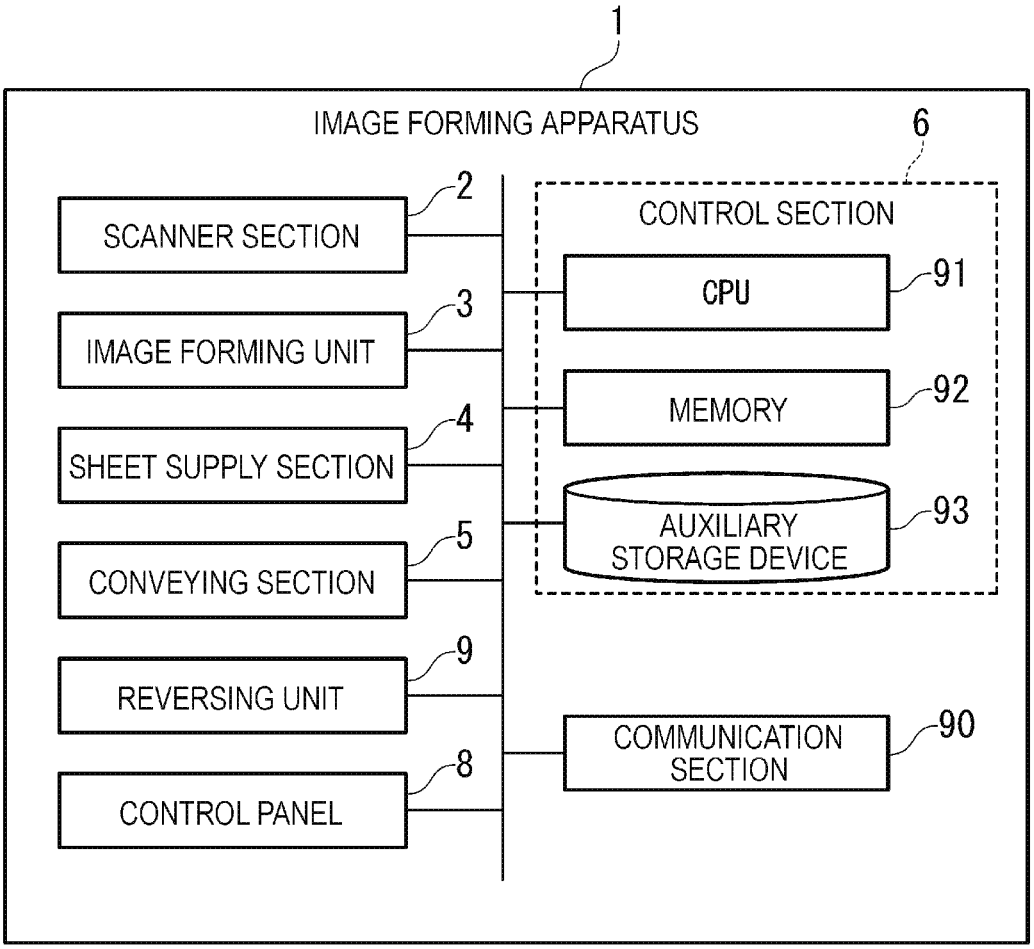
FIG. 2 depicts a hardware configuration of an image processing apparatus.

FIG. 2 is a hardware configuration view of the image processing apparatus in the first embodiment. The image forming apparatus 1 includes a central processing unit (CPU) 91, a memory 92, an auxiliary storage device 93, and the like which are connected to each other by a bus, and executes programs. The image forming apparatus 1 functions as an apparatus including the scanner section 2, the image forming unit 3, the sheet supply section 4, the conveying section 5, the reversing unit 9, the control panel 8, and a communication section 90 by executing programs.

The CPU 91 functions as the control section 6 by executing programs stored in the memory 92 and the auxiliary storage device 93. The control section 6 controls the operations of each functional section of the image forming apparatus 1.

The auxiliary storage device 93 is configured by using a storage device such as a magnetic hard disk device or a semiconductor storage device. The auxiliary storage device 93 stores information.

The communication section 90 is configured to include a communication interface for connecting the own device to an external device. The communication section 90 communicates with an external device via a communication interface.

Figure 3:
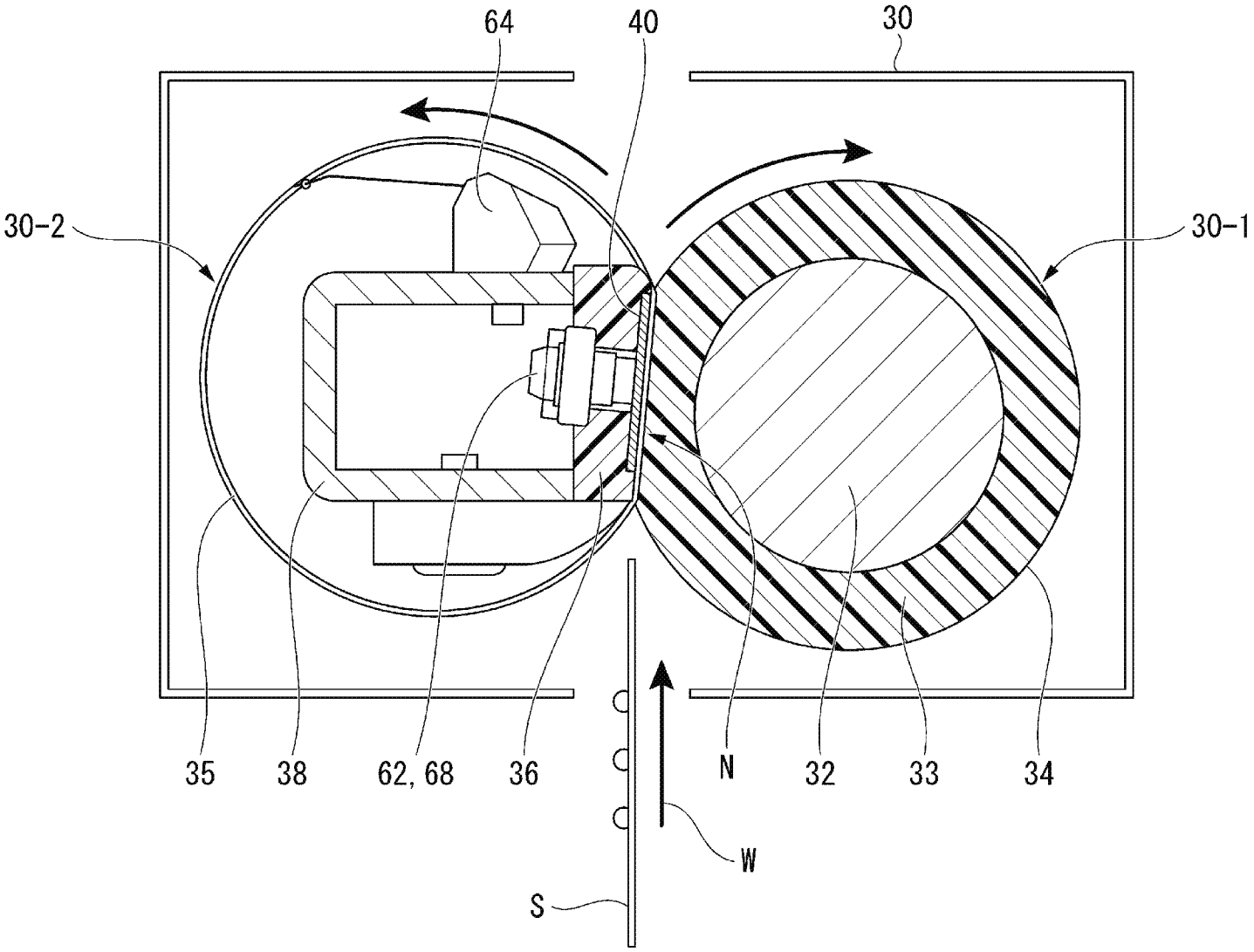
FIG. 3 is a cross-sectional view of a heating device.

FIG. 3 is a cross-sectional view of the heating device in a first embodiment. The heating device in the first embodiment is the fixing device 30. The fixing device 30 includes a pressure roller 30-1 and a film unit 30-2.

The pressure roller 30-1 forms a nip N with the film unit 30-2. The pressure roller 30-1 applies pressure to the toner image formed on the front surface of the sheet S that has entered the nip N. The pressure roller 30-1 revolves to convey the sheet S. The pressure roller 30-1 has a cored bar 32, an elastic layer 33, and a release layer 34.

Figure 9:
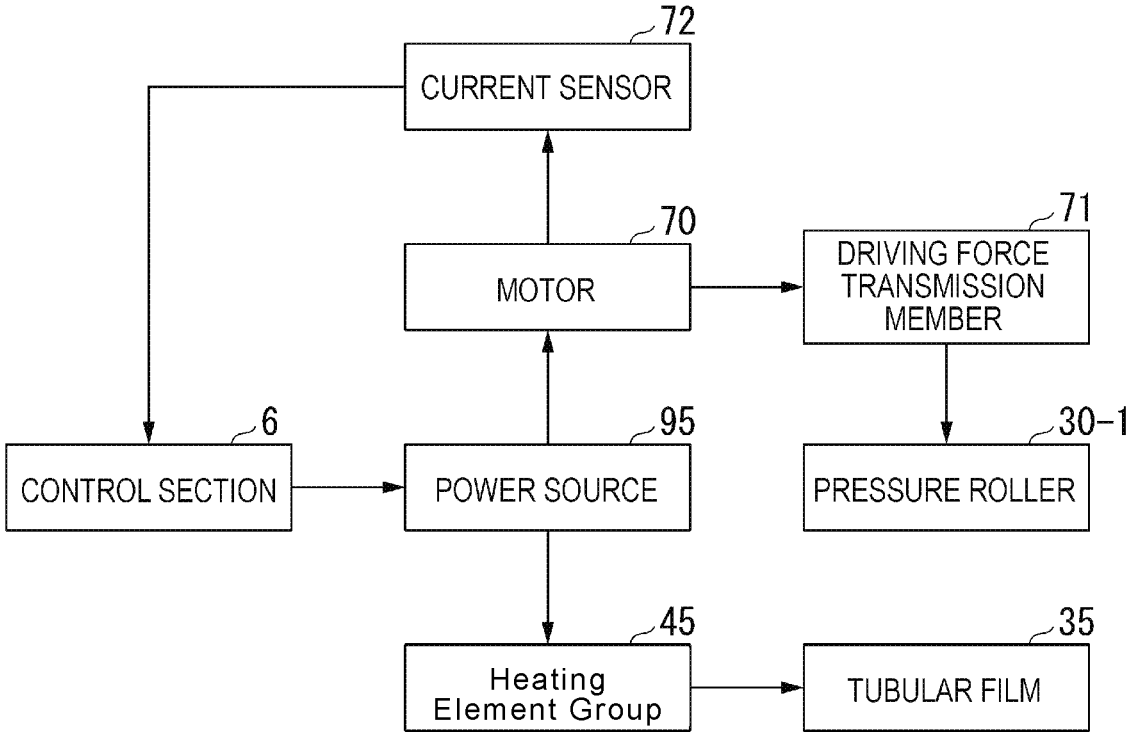
FIG. 9 is a block diagram depicting certain hardware-related aspects of a heating device related to heating control.

The cored bar 32 is formed in a columnar shape with a metal material such as stainless steel. Both end of the cored bar 32 in the axial direction are rotatably supported. A rotating force generated by a motor 70 (driving section) illustrated in FIG. 9 is transmitted to the cored bar 32 via a driving force transmission member 71, and accordingly, the cored bar 32 is rotationally driven. When the cored bar 32 is rotationally driven, the pressure roller 30-1 rotates, and a tubular film 35 (fixing belt) rotates in a driven manner.

The cored bar 32 abuts against a cam member or the like. The cam member can rotate to move the cored bar 32 closer to and away from the film unit 30-2.

The elastic layer 33 is made of an elastic material such as silicone rubber. The elastic layer 33 is formed with a constant thickness on the outer peripheral surface of the cored bar 32.

The release layer 34 is made of a resin material such as tetrafluoroethylene/perfluoroalkyl vinyl ether copolymer (PFA). The release layer 34 is formed on the outer peripheral surface of the elastic layer 33.

For example, when the outer diameter of the pressure roller 30-1 is 20 mm to 40 mm, it is preferable that the outer diameter of the cored bar 32 is set to 10 mm to 20 mm, the thickness of the elastic layer 33 to 5 mm to 20 mm, and the thickness of the release layer 34 to 20 μm to 40 μm.

The hardness of the outer peripheral surface of the pressure roller 30-1 is desirably 40° to 70° with an ASKER-C hardness tester under a load of 9.8 [N]. Accordingly, the area of the nip N and the durability of the pressure roller 30-1 are ensured.

The pressure roller 30-1 can move toward and away from the film unit 30-2 by the rotation of the cam member. When the pressure roller 30-1 is moved toward to the film unit 30-2 and is pressed by a pressing spring or mechanism, the nip N is formed. However, when a sheet S is jammed in the fixing device 30, the jammed sheet S can be more easily removed by moving the pressure roller 30-1 away from the film unit 30-2. When the tubular film 35 stops rotating, such as during a device sleep or idle state, the pressure roller 30-1 can be moved away from the film unit 30-2 to prevent plastic deformation (creep) of the pressure roller 30-1 and the tubular film 35.

The pressing spring may be adjusted such that the pressing force between the film unit 30-2 and the pressure roller 30-1 is 300 N to 500 N in total pressure, for example.

The pressure roller 30-1 is rotatably supported between device frame side plates, via a bearing member or the like, at both ends of the cored bar 32 in the longitudinal direction. The rotating force generated by the motor 70 (also referred to as a driving section or driving mechanism) is transmitted by the driving force transmission member 71, and accordingly, the pressure roller 30-1 is driven to rotate. When the pressure roller 30-1 rotates when the nip N is formed, the tubular film 35 of the film unit 30-2 is driven to rotate. The pressure roller 30-1 conveys the sheet S in a conveying direction W by rotating.

The film unit 30-2 heats the toner image on the sheet S that entered the nip N. The film unit 30-2 includes a tubular film 35, the heater unit 40, a support member 36, a stay 38, a heater thermometer 62, a thermostat 68, and a film thermometer 64.

The tubular film 35 (also referred to as a fixing belt, a cylindrical film, tubular body, or the like) is formed in the cylindrical shape. The tubular film 35 has, in order from the inner peripheral side, a base layer made of a sheet-like member having high heat resistance, an elastic layer that improves fixing properties, and a release layer that is the outermost surface layer. The base layer is made of a metal material such as nickel (Ni) or stainless steel in a tubular shape. The elastic layer is disposed to be laminated on the outer peripheral surface of the base layer. The elastic layer is made of an elastic material such as silicone rubber. The release layer is disposed to be laminated on the outer peripheral surface of the elastic layer. The release layer is made of a material such as PFA resin.

In order to shorten the warm-up time, it is preferable to set the thickness of the elastic layer and the release layer such that the heat capacity of each layer is not extremely large. For example, when the inner diameter of the tubular film 35 is 20 mm to 40 mm, it is preferable that the thickness of the base layer is set to 30 μm to 50 μm, the thickness of the elastic layer to 100 μm to 300 μm, and the thickness of the release layer to 20 μm to 40 μm.

Coating may be applied to the inside of the base layer to improve slidability (reduce friction) with the heater unit 40.

Figure 4:
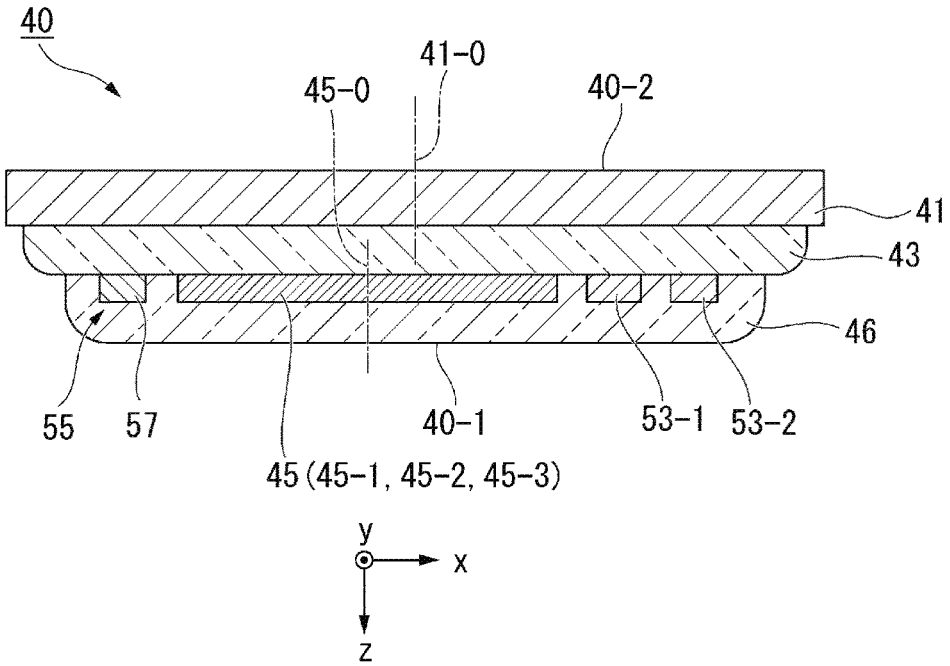
FIG. 4 is a cross-sectional view of a heater unit.
Figure 5:
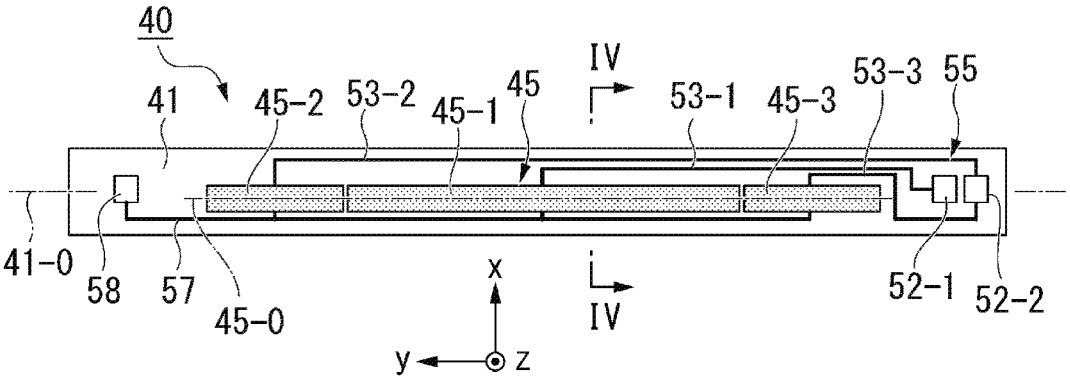
FIG. 5 is a bottom view of a heater unit.

FIG. 4 is a front sectional view of the heater unit along line IV-IV in FIG. 5. FIG. 5 is the bottom view (viewed from the +z direction) of the heater unit. The heater unit 40 has a substrate 41, a heating element group 45, and a wiring group 55.

The substrate 41 (heating element board) is made of a metal material such as stainless steel or a ceramic material such as aluminum nitride. The substrate 41 is formed in a shape of an elongated rectangular plate. The substrate 41 is disposed on the inside of the tubular film 35 in the radial direction. The substrate 41 has the shaft direction of the tubular film 35 as the longitudinal direction thereof.

In this application, the x direction, the y direction, and the z direction are defined as follows.

The y direction is the longitudinal direction of the substrate 41 (heater unit 40). The +y direction is a direction from a center heating element 45-1 to a first end heating element 45-2.

The x direction is the width direction of the substrate 41. The +x direction is the conveying direction (downward direction) for the sheet S.

The z direction is orthogonal to the substrate 41. The +z direction is a direction in which the heating element group 45 is disposed with respect to the substrate 41. An insulating layer 43 is made of glass material or the like on the +z direction side of the substrate 41 in the. The +z direction surface (first surface 40-1) of the heater unit 40 abuts against the inner peripheral surface of the tubular film 35 (refer to FIG. 3).

The heating element group 45 is disposed on the substrate 41. The heating element group 45 is formed on the surface of the insulating layer 43 in the +z direction, as illustrated in FIG. 4. The heating element group 45 is made of a silver-palladium alloy or the like. The outer shape of the heating element group 45 is formed in a rectangular shape, with the y direction as the longitudinal direction and the x direction as the lateral direction. The heating element group 45 is formed by, for example, screen printing.

As illustrated in FIG. 5, the heating element group 45 has a first heating element 45-2, a center heating element 45-1, and a second end heating element 45-3, which are provided spaced from one another along the y direction. The heating element group 45 has the first end heating element 45-2, the center heating element 45-1, and the second end heating element 45-3, which are arranged in line along the y direction.

In this embodiment, the heating element group 45 configured with a plurality of heating elements is used, but a configuration in which a single heating element is used may also be adopted.

The center heating element 45-1 is disposed at the center of the heating element group 45 along the y direction. In some examples, the center heating element 45-1 may be a plurality of smaller heating elements arranged in line along the y direction.

The first end heating element 45-2 is disposed at the +y direction end portion in the of the center heating element 45-1, that is, on the +y direction side of the heating element group 45.

The second end heating element 45-3 is disposed at the −y direction end portion of the center heating element 45-1, that is, on the −y direction side of the heating element group 45.

The boundary line between the center heating element 45-1 and the first end heating element 45-2 is disposed in parallel to the x direction. The boundary between the center heating element 45-1 and the first end heating element 45-2 may be disposed intersecting the x direction. The same applies to the boundary between the center heating element 45-1 and the second end heating element 45-3.

The heating element group 45 generates heat when energized. The electrical resistance value of the center heating element 45-1 is smaller than the electrical resistance value of the first end heating element 45-2 and the second end heating element 45-3. The electrical resistance values of the first end heating element 45-2 and the second end heating element 45-3 are substantially the same as each other. Here, the electrical resistance value of the center heating element 45-1 is a "center resistance value A", and the electrical resistance value of the first end heating element 45-2 (and the second end heating element 45-3) is an "end portion resistance value B". For example, the ratio of the center portion resistance value A to the end portion resistance value B (A:B) is preferably in the range of 3:1 to 7:1, and more preferably in the range of 4:1 to 6:1.

A sheet S with a small width in the y direction can pass through the center portion of the fixing device 30. In this case, the control section 6 can heat only the center heating element 45-1. However, the control section 6 needs to heat the entire heating element group 45 for a sheet S having a large width in the y direction. Therefore, the center heating element 45-1, the first end heating element 45-2, and the second end heating element 45-3 are all controlled to generate heat. The heat generation of the center heating element 45-1 can be controlled independently of the first end heating element 45-2 and the second end heating element 45-3, which can be controlled in the same manner as one another.

The wiring group 55 is made of metallic materials such as silver. The wiring group 55 has a center portion contact 52-1, a center portion wiring 53-1, an end portion contact 52-2, a first end portion wiring 53-2, a second end portion wiring 53-3, a common contact 58, and a common wiring 57.

The center portion contact 52-1 is disposed in the −y direction of the heating element group 45.

The center portion wiring 53-1 is disposed in the +x direction of the heating element group 45. The center portion wiring 53-1 connects the +x direction end edge of the center heating element 45-1 to the center portion contact 52-1.

The end portion contact 52-2 is disposed in the −y direction of the center portion contact 52-1.

The first end portion wiring 53-2 is disposed in the +x direction of the heating element group 45, that is, in the +x direction of the center portion wiring 53-1. The first end portion wiring 53-2 connects the +x direction end edge of the first end portion heating element 45-2 to the +x direction end portion of the end portion contact 52-2 in the.

The second end portion wiring 53-3 is disposed in the +x direction of the heating element group 45, that is, in the −x direction of the center portion wiring 53-1. The second end portion wiring 53-3 connects the end edge of the second end heating element 45-3 in the +x direction to the −x direction end portion of the end portion contact 52-2.

The common contact 58 is disposed in the +y direction of the heating element group 45.

The common wiring 57 is disposed in the −x direction of the heating element group 45. The common wiring 57 connects the −x direction end edges of the center heating element 45-1, the first end heating element 45-2, and the second end heating element 45-3 to the common contact 58.

In this manner, the second end portion wiring 53-3, the center portion wiring 53-1, and the first end portion wiring 53-2 are arranged in the +x direction of the heating element group 45. In contrast, only the common wiring 57 is disposed in the −x direction of the heating element group 45. Therefore, a center 45-0 of the heating element group 45 in the x direction is disposed in the −x direction from a center 41-0 of the substrate 41 in the x direction.

As illustrated in FIG. 4, the heating element group 45 and the wiring group 55 are formed on the surface of the insulating layer 43 in the +z direction. A protective layer 46 is made of glass material or the like to cover the heating element group 45 and the wiring group 55. The protective layer 46 protects the heating element group 45 and the wiring group 55. The protective layer 46 improves the slidability (reduces friction) between the heater unit 40 and the tubular film 35.

As illustrated in FIG. 3, the heater unit 40 is disposed inside the tubular film 35. The inner peripheral surface of the tubular film 35 is coated with grease (or other lubricant). The heater unit 40 comes into contact with the inner peripheral surface of the tubular film 35 via grease. Grease is disposed between the first surface 40-1 (refer to FIG. 4) of the heater unit 40 and the inner peripheral surface of the tubular film 35. When the heater unit 40 generates heat, the viscosity of grease decreases. Accordingly, the slidability between the heater unit 40 and the tubular film 35 is improved (friction is reduced).

As the support member 36, a member having rigidity, heat-resistance, and heat-insulating properties is used. The support member 36 is made of elastic materials such as silicone rubber and fluororubber, and resin materials such as polyimide resin, polyphenylene sulfide (PPS), polyethersulfone (PES), and liquid crystal polymer. The heater unit 40 and the support member 36 are integrally configured. The support member 36 is disposed to cover both sides of the heater unit 40 in the −z direction and in the x direction. The support member 36 supports the heater unit 40. Both ends of the support member 36 in the x direction are rounded. The support member 36 has a semi-circular tub-shaped cross section. The support member 36 supports the inner peripheral surface of the tubular film 35 at both end portions of the heater unit 40 in the x direction. The support member 36 supports one surface of the heater unit 40.

When heating the sheet S passing through the fixing device 30, temperature distribution occurs in the heater unit 40 according to the size of the sheet S. When the heater unit 40 becomes locally hot, there is a possibility that the temperature of the heat unit exceeds the heat resisting temperature of the support member 36, which is made of resin material.

The stay 38 is made of steel plate material or the like. The cross-section perpendicular to the y direction of the stay 38 is formed in a U shape. For example, the stay 38 is formed by bending steel material having a thickness of 1 mm to 3 mm. The stay 38 is mounted in the −z direction of the support member 36 such that the opening portion of the U shape is blocked by the support member 36. The stay 38 extends in the y direction. Both end portions of the stay 38 in the y direction are fixed to the housing of the image forming apparatus 1. Accordingly, the film unit 30-2 is supported by the image forming apparatus 1. The stay 38 improves the bending rigidity of the film unit 30-2.

A flange can be mounted near both y direction end portions of the stay 38 in the to restrict the movement of the tubular film 35 in the y direction.

The heater thermometer 62 is disposed in the −z direction of the heater unit 40. For example, the heater thermometer 62 is a thermistor. The heater thermometer 62 is mounted and supported on the surface of the support member 36 in the −z direction. The temperature sensitive element of the heater thermometer 62 comes into contact with the heater unit 40 through a hole passing through the support member 36 in the z direction. The heater thermometer 62 measures the temperature of the heater unit 40.

The thermostat 68 is disposed similarly to the heater thermometer 62. The thermostat 68 is integrated into an electrical circuit which will be described later. The thermostat 68 stops energizing the heating element group 45 when the measured temperature of the heater unit 40 exceeds a predetermined temperature.

Figure 6:
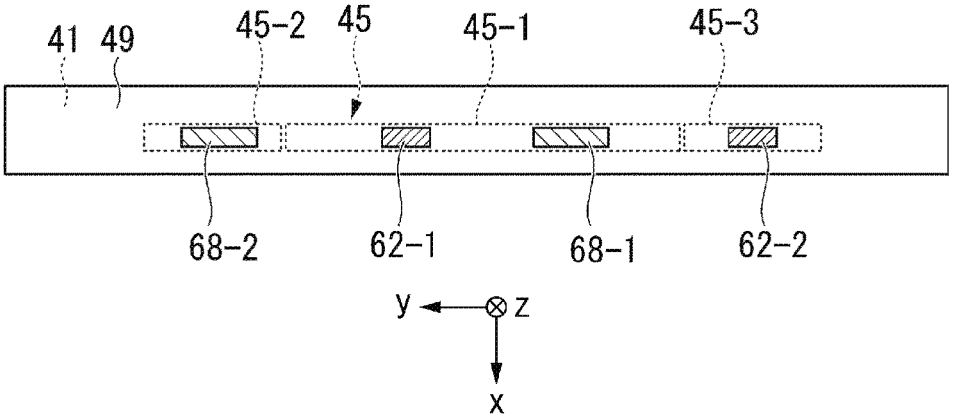
FIG. 6 is a plan view indicting positions of a heater thermometer and a thermostat.

FIG. 6 is a plan view (viewed from the −z direction) of the heater thermometer 62 and the thermostat 68. In FIG. 6, the description of the support member 36 is omitted. The following description of the arrangement of the heater thermometer 62, the thermostat 68, and the film thermometer 64 describes the arrangement of the respective temperature sensitive elements.

The plurality of heater thermometers 62 (a center heater thermometer 62-1 and an end heater thermometer 62-2) are arranged in line in the y direction. The plurality of heater thermometers 62 are disposed on the heating element group 45. The plurality of heater thermometers 62 are disposed in the area of the heating element group 45 in the y direction. The plurality of heater thermometers 62 are disposed at the center of the heating element group 45 in the x direction. In other words, when viewed from the z direction, the plurality of heater thermometers 62 and the heating element sets 45 at least partially overlap each other.

The plurality of thermostats 68 (including in this example, a center thermostat 68-1 and an end thermostat 68-2) are as arranged in a manner similar to that of the plurality of heater thermometers 62.

The plurality of heater thermometers 62 includes the center heater thermometer 62-1 and the end heater thermometer 62-2 (a thermometer disposed on one side in the longitudinal direction).

The center heater thermometer 62-1 measures the temperature of the center heating element 45-1. The center heater thermometer 62-1 is disposed within the area of the center heating element 45-1. In other words, when viewed from the z direction, the center heater thermometer 62-1 and the center heating element 45-1 overlap each other.

The end heater thermometer 62-2 measures the temperature of the second end heating element 45-3. As described above, the heat generation of the first end heating element 45-2 and the second end heating element 45-3 are controlled in the same manner. Therefore, the temperature of the first end heating element 45-2 is considered to be equivalent to the temperature of the second end heating element 45-3. The end heater thermometer 62-2 is disposed within the range (planar area) of the second end heating element 45-3. In other words, when viewed from the z direction, the end heater thermometer 62-2 and the second end heating element 45-3 overlap each other at least partially.

The plurality of thermostats 68 include the center thermostat 68-1 and the end thermostat 68-2.

The center thermostat 68-1 stops power to the heating element group 45 when the temperature of the center heating element 45-1 exceeds a predetermined temperature. The center thermostat 68-1 is disposed within the range (planar area) of the center heating element 45-1. In other words, when viewed from the z direction, the center thermostat 68-1 and the center heating element 45-1 overlap each other at least partially.

The end thermostat 68-2 stops power to the heating element group 45 when the temperature of the first end heating element 45-2 exceeds a predetermined temperature. As noted above, the heat generation of the first end heating element 45-2 and the second end heating element 45-3 are controlled in the same manner as each other. Therefore, the temperature of the first end heating element 45-2 can be considered equivalent to the temperature of the second end heating element 45-3. The end thermostat 68-2 is disposed within the range (planar area) of the first end heating element 45-2. In other words, when viewed from the z direction, the end thermostat 68-2 and the first end heating element 45-2 overlap each other at least partially.

In this manner, the center heater thermometer 62-1 and the center thermostat 68-1 are disposed on the center heating element 45-1. Accordingly, the temperature of the center heating element 45-1 is measured. Power to the heating element group 45 is stopped when the temperature of the center heating element 45-1 exceeds a predetermined temperature.

The end heater thermometer 62-2 is disposed on the second end heating element 45-3. Accordingly, the temperature of the second end heating element 45-3 is also measured. Since the temperature of the first end heating element 45-2 is assumed equivalent to the temperature of the second end heating element 45-3, the temperature of the first end heating element 45-2 and the second end heating element 45-3 can be measured.

The end thermostat 68-2 is disposed on the first end heating element 45-2. When the temperature of the first end heating element 45-2 and the second end heating element 45-3 exceeds a predetermined temperature, power to the heating element group 45 is stopped.

The plurality of heater thermometers 62 and the plurality of thermostats 68 are arranged alternately in line along the y direction. As described above, the first end heating element 45-2 is disposed in the +y direction of the center heating element 45-1. The end thermostat 68-2 is disposed within the range (planar area) of the first end heating element 45-2. The center heater thermometer 62-1 is disposed in the +y direction from the center of the center heating element 45-1. The center thermostat 68-1 is disposed in the −y direction from the center of the center heating element 45-1. As described above, the second end heating element 45-3 is disposed in the −y direction of the center heating element 45-1. The end heater thermometer 62-2 is disposed within the planar area (range) of the second end heating element 45-3. Accordingly, the end thermostat 68-2, the center heater thermometer 62-1, the center thermostat 68-1, and the end heater thermometer 62-2 are arranged in line in this order from the +y direction to the −y direction.

In general, the thermostats 68 function to connect and disconnect the electrical circuit based on the deformation of a bimetal (bimetallic) strip that varies with temperature change. Thus, these thermostats 68 are formed in an elongated shape corresponding to the shape of the bimetal strip element. Additionally, terminals also extend outward from both end portions of the thermostat 68 in the longitudinal direction. Connectors for external wiring are connected to these terminals by solder or paste. Therefore, it is necessary to ensure a space on the outside of the thermostat 68 in the longitudinal direction. The longitudinal direction of the thermostat 68 is along the y direction because there is typically little to no space available in the x direction in a fixing device 30. Thus, when a plurality of thermostats 68 are disposed next to each other along the y direction, it becomes difficult to provide a connection space for the external wiring.

However, as described above, the plurality of heater thermometers 62 and the plurality of thermostats 68 are arranged alternately along the y direction. Accordingly, a heater thermometer 62 can be disposed next to the thermostat 68 in the y direction. Therefore, the space for connection of the external wiring to the thermostat 68 can be provided. The degree of freedom in the layout of the thermostat 68 and the heater thermometer 62 in the y direction is thus increased. Accordingly, the temperature of the fixing device 30 can be controlled by disposing the thermostat 68 and the heater thermometer 62 at more optimum positions. Furthermore, it becomes easy to separate an alternating current (AC) wiring connected to the plurality of thermostats 68 from the direct current (DC) wiring connected to the plurality of heater thermometers 62. Accordingly, the generation of noise in electrical circuits can be reduced.

As illustrated in FIG. 3, the film thermometer 64 is disposed inside the tubular film 35 in the +x direction side of the heater unit 40. The film thermometer 64 comes into contact with the inner peripheral surface of the tubular film 35 and measures the temperature of the tubular film 35.

Figure 7:
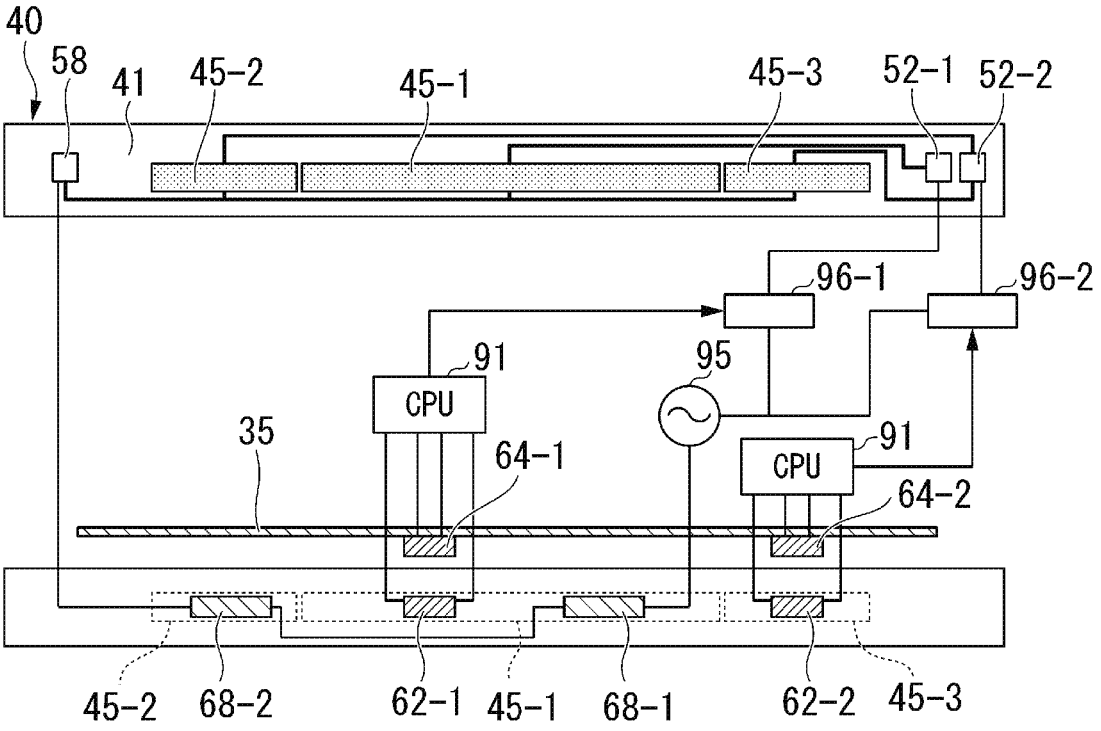
FIG. 7 depicts electrical aspects of a heating device.

FIG. 7 is an electrical circuit view of the heating device in the first embodiment. In FIG. 7, the bottom view in FIG. 5 is disposed above the paper surface, and the plan view in FIG. 6 is disposed below the paper surface, respectively. FIG. 7 also describes the plurality of film thermometers 64 along with a section of the tubular film 35 above the lower plan view. The plurality of film thermometers 64 include a center film thermometer 64-1 and an end film thermometer 64-2 (a thermometer disposed on one side of the longitudinal direction).

The center film thermometer 64-1 comes into contact with the center portion of the tubular film 35 in the y direction. The center film thermometer 64-1 comes into contact with the tubular film 35 within the area of the center heating element 45-1 in the y direction. The center film thermometer 64-1 measures the temperature of the center portion of the tubular film 35 in the y direction.

The end film thermometer 64-2 comes into contact with the end portion of the tubular film 35 in the −y direction. The end film thermometer 64-2 comes into contact with the tubular film 35 within the area of the second end heating element 45-3 in the y direction. The end film thermometer 64-2 measures the temperature of the end portion of the tubular film 35 in the −y direction. As described above, the heat generation of the first end heating element 45-2 and the second end heating element 45-3 is controlled in the same manner. Therefore, the temperature of the −y direction end portion of the tubular film 35 is considered equivalent to the temperature of the +y direction end portion.

A power source 95 is connected to the center portion contact 52-1 via a center triac 96-1. The power source 95 is connected to the end portion contact 52-2 via an end triac 96-2. The CPU 91 controls the ON and OFF of the center triac 96-1 and the end triac 96-2 independently of each other. When the CPU 91 turns on the center triac 96-1, the power source 95 energizes the center heating element 45-1. Accordingly, the center heating element 45-1 generates heat. When the CPU 91 turns on the end triac 96-2, the power source 95 energizes the first end heating element 45-2 and the second end heating element 45-3. Accordingly, the first end heating element 45-2 and the second end heating element 45-3 generate heat. As described above, the center heating element 45-1, the first end heating element 45-2, and the second end heating element 45-3 may be controlled to generate heat independently of each other. In this example, the center heating element 45-1 is controlled independently of the first end heating element 45-2 and the second end heating element 45-3. The center heating element 45-1, the first end heating element 45-2, and the second end heating element 45-3 are connected to the power source 95 in parallel.

The power source 95 is connected to the common contact 58 via the center thermostat 68-1 and the end thermostat 68-2. The center thermostat 68-1 and the end thermostat 68-2 are connected to each other in series.

When the temperature of the center heating element 45-1 rises abnormally, the measured temperature of the center thermostat 68-1 eventually exceeds a predetermined temperature. At this time, the center thermostat 68-1 stops power to the entire heating element group 45 from the power source 95.

When the temperature of the first end heating element 45-2 rises abnormally, the measured temperature of the end thermostat 68-2 eventually exceeds a predetermined temperature. At this time, the end thermostat 68-2 stops power to the entire heating element group 45 from the power source 95. As described above, the heat generation of the first end heating element 45-2 and the second end heating element 45-3 are controlled together. Therefore, when the temperature of the second end heating element 45-3 rises abnormally, the temperature of the first end heating element 45-2 will rise as well. Therefore, if the temperature of the second end heating element 45-3 rises abnormally, the end thermostat 68-2 will similarly stop power to the entire heating element group 45 from the power source 95.

The temperature of the center heating element 45-1 is measured by the center heater thermometer 62-1. The CPU 91 receives measured temperature from the center heater thermometer 62-1. The temperature of the second end heating element 45-3 is measured by the end heater thermometer 62-2. The CPU 91 receives measured temperature from the end heater thermometer 62-2. The temperature of the second end heating element 45-3 is considered equivalent to the temperature of the first end heating element 45-2. The CPU 91 thus receives the measured temperature (s) of the heating element group 45 from the heater thermometers 62 when the fixing device 30 is started. When the temperature of the heating element group 45 is lower than the predetermined temperature, the CPU 91 causes the heating element group 45 to be heated for a short period of time. After this, the CPU 91 begins the rotation of the pressure roller 30-1. The heat generated by the heating element group 45 before the start of rotation serves to reduce the viscosity of the grease applied to the inner peripheral surface of the tubular film 35. Accordingly, the friction between the heater unit 40 and the tubular film 35 is reduced at the start of rotation of the pressure roller 30-1.

The center portion of the tubular film 35 along the y direction is measured by the center film thermometer 64-1. CPU 91 receives this measured temperature from the center film thermometer 64-1. The temperature of the −y direction end portion of the tubular film 35 is measured by the end film thermometer 64-2. CPU 91 receives this measured temperature from the end film thermometer 64-2. The temperature of the end portion of the tubular film 35 in the −y direction is considered equivalent to the temperature of the end portion of the tubular film 35 in the +y direction. The CPU 91 thus receives the temperature of the center portion and the end portions of the tubular film 35 during the operation of the fixing device 30. The CPU 91 can control the phase or frequency of the electric power supplied to the heating element group 45 by the center triac 96-1 and the end triac 96-2. The CPU 91 controls the energization of the center heating element 45-1 based on the temperature measurement results for the center portion of the tubular film 35. The CPU 91 controls the energization of the first end heating element 45-2 and the second end heating element 45-3 based on the temperature measurement results of an end portion of the tubular film 35.

Heating of at least two end heating elements (the first end heating element 45-2 and the second end heating element 45-3) out of the plurality of heating elements is controlled by CPU 91 (control section 6). The center heater thermometer 62-1 measures the temperature of the center heating element 45-1. The end heater thermometer 62-2 measures the temperature of one (in this example, second end heating element 45-3) of the two end heating elements.

The plurality of heating elements includes a second end heating element 45-3 disposed on one end and a first end heating element 45-2 disposed on the other end of the plurality of heating elements. The end heater thermometer 62-2 and the end film thermometer 64-2 are disposed on the same side as the second end heating element 45-3. The end heater thermometer 62-2 and the end film thermometer 64-2 are not disposed on the same side as the first end heating element 45-2.

Figure 8:
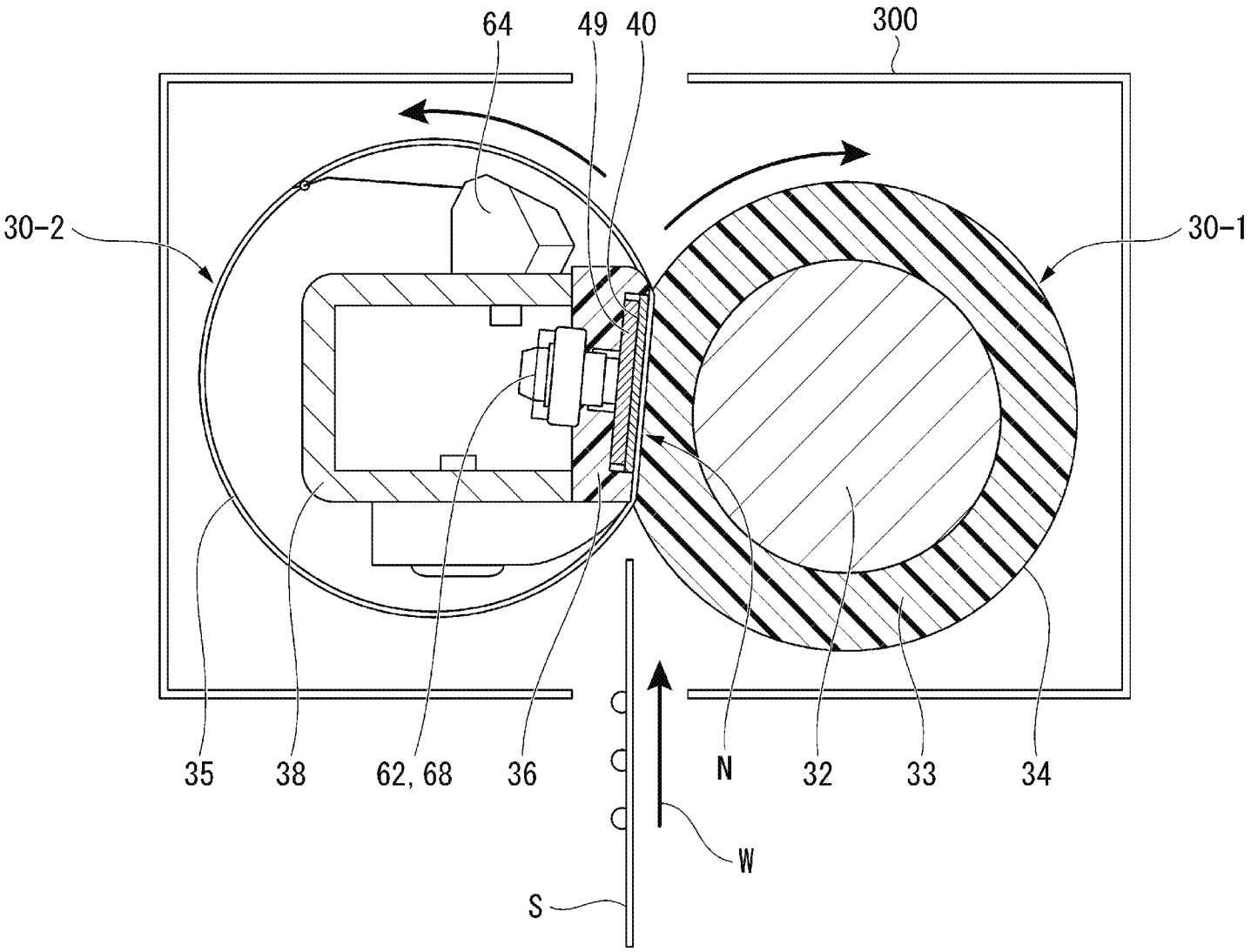
FIG. 8 is a cross sectional view of another configuration example.

The configuration of the heating device may be different from that of the fixing device 30 illustrated in FIG. 3 above, such as the configuration illustrated in FIG. 8.

FIG. 8 is a cross-sectional view of another configuration example of the heating device in the first embodiment. The heating device illustrated in FIG. 8 is a fixing device 300. The configuration of the fixing device 300 is similar to that of the fixing device 30 with the addition of a heat transfer member 49. The configuration of the fixing device 300 will be described focusing on the differences with fixing device 30. The components having the same configuration as that of the fixing device 30 will be given the same reference signs and the additional description thereof will be omitted.

The film unit 30-2 includes a tubular film 35, the heater unit 40, the heat transfer member 49, the support member 36, the stay 38, the heater thermometer 62, the thermostat 68, and the film thermometer 64.

The heat transfer member 49 is made of a metal material having high thermal conductivity, such as copper. The outer shape of the heat transfer member 49 is equivalent to the outer shape of the substrate 41 of the heater unit 40. The heat transfer member 49 is disposed to be in contact with the surface (second surface 40-2, refer to FIG. 4) of the heater unit 40 in −z direction.

The support member 36 supports the heater unit 40 via the heat transfer member 49.

The heat transfer member 49 reduces temperature gradient in the longitudinal direction of the tubular film 35 and the heater unit 40, and averages temperature distribution of the tubular film 35 and the heater unit 40. Accordingly, the heat transfer member 49 prevents local temperature rise in the longitudinal direction of the tubular film 35 and the heater unit 40.

The heater thermometer 62 is disposed in the −z direction of the heater unit 40 with the heat transfer member 49 interposed therebetween. For example, the heater thermometer 62 is a thermistor. The heater thermometer 62 is mounted and supported on the surface of the support member 36 in the −z direction. The temperature sensitive element of the heater thermometer 62 comes into contact with the heat transfer member 49 through a hole passing through the support member 36 in the z direction. The heater thermometer 62 measures the temperature of the heater unit 40 via the heat transfer member 49.

The thermostat 68 is disposed similarly to the heater thermometer 62. The thermostat 68 is integrated into an electrical circuit which will be described later. The thermostat 68 stops energizing the heating element group 45 when the temperature of the heater unit 40, which was measured via the heat transfer member 49, exceeds a predetermined temperature.

Hereinafter, the heating control by the heating device (fixing devices 30 and 300) in the first embodiment will be described below.

FIG. 9 is a block diagram excerpting the main components of the heating device used in the heating control described below.

The power source 95 supplies electric power to the heating element group 45.

The heating element group 45 heats the tubular film 35.

The power source 95 supplies electric power to the motor 70. The power generated by the motor 70, to which the electric power was supplied, is transmitted to the driving force transmission member 71. The driving force transmission member 71 is, for example, a driving gear.

The driving force transmission member 71 converts the power transmitted from the motor 70 into a rotating force that rotates the pressure roller 30-1, and rotates the pressure roller 30-1.

The pressure roller 30-1 is given a rotating force from the driving force transmission member 71 and is rotationally driven at a predetermined speed in a clockwise direction, for example.

The tubular film 35 abuts against the pressure roller 30-1. In the nip N formed by the contact between the tubular film 35 and the pressure roller 30-1, a frictional force works as the pressure roller 30-1 is rotationally driven. The frictional force in the nip N causes a rotating force to act on the tubular film 35 by the driven action. For example, the pressure of the pressure spring may be set such that the pressing force between the tubular film 35 and the pressure roller 30-1 is 300 to 500 N in total pressure.

The current sensor 72 measures the driving current of the motor 70. The current sensor 72 measures the driving current, for example, on the base or control board of the motor 70. The current sensor 72 outputs information indicating the measurement result to the control section 6. The measurement result is, for example, the current value of the driving current of the motor 70.

The control section 6 acquires the information indicating the measurement result of the driving current of the motor 70, which was output from the current sensor 72. The control section 6 (memory 92) may temporarily store the acquired information.

The current value of the driving current of the motor 70 is correlated with the driving torque of the motor 70. Accordingly, the control section 6 can estimate the driving torque of the motor 70 from the value based on the current value of the measured driving current. The value based on the current value of the driving current here also includes the current value of the driving current itself. The value based on the current value of the driving current may be a value that is converted from the current value of the driving current, such as the driving torque of the motor 70.

For example, when the current value of the driving current of the motor 70 is extremely high, it is estimated that the driving torque is extremely large, and the residual amount of lubricant decreases. For example, when the current value of the driving current of the motor 70 is extremely low, it is estimated that the driving torque is extremely small, and the contact between the tubular film 35 and the pressure roller 30-1 is defective.

When the heating element group 45 is heating the tubular film 35, and the rotation of the tubular film 35 stops, the temperature in the vicinity of the heating element group 45 rises rapidly. This is due, for example, to the fact that the sheet S is not fed between the tubular film 35 and the pressure roller 30-1 due to the stop of rotation of the tubular film 35, and the heat is no longer taken away by the sheet S. The rotation of the tubular film 35 stops mainly due to a decrease in residual amount of lubricant or poor abutment between the tubular film 35 and the pressure roller 30-1. When the temperature in the vicinity of the heating element group 45 rises rapidly, there can be a case where the tubular film 35 or the like is damaged.

As described above, when the rotation of the tubular film 35 stops due to a decrease in the amount of lubricant, the driving torque of the motor 70 becomes greater than that at normal times. Accordingly, the driving current measured by the current sensor 72 is greater than that at normal times.

When the rotation of the tubular film 35 stops due to poor abutment between the tubular film 35 and the pressure roller 30-1, the driving torque of the motor 70 becomes less than that at normal times. Accordingly, the current value of the driving current measured by the current sensor 72 is less than that at normal times.

The control section 6 (more particularly in this example, memory 92) stores a threshold value in advance for determining that the rotation of the tubular film 35 stopped due to a decrease in residual amount of lubricant. The threshold value is an upper limit value of the value based on the driving current of the motor 70. In the following description, the stopping of rotation of the tubular film 35 due to a decrease in the remaining amount of lubricant is referred to as a "first abnormality".

The control section 6 (more particularly in this example, memory 92) stores a threshold value in advance for determining that the rotation of the tubular film 35 has stopped due to poor abutment between the tubular film 35 and the pressure roller 30-1. The threshold value is the lower limit value of the value that is based on the driving current of the motor 70. In the following description, the stopping of rotation of the tubular film 35 due to poor abutment between the tubular film 35 and the pressure roller 30-1 is referred to as a "second abnormality".

When the value based on the current value indicated by the measurement result of the driving current output from the current sensor 72 is not a value within the predetermined range, the control section 6 controls the power source 95 to stop the supply of electric power to the heating element group 45. Accordingly, the heating of the tubular film 35 stops. In this case, the control section 6 may control the power source 95 to further stop the supply of electric power to the motor 70.

The predetermined range is the range between the upper limit value and the lower limit value for the value based on the driving current of the motor 70. In the following description, when the value based on the driving current of the motor 70 is not within a predetermined range, this is referred to as being "out of the predetermined range".

An example of the operation of the fixing device 30 in the first embodiment will be described.

Figure 10:
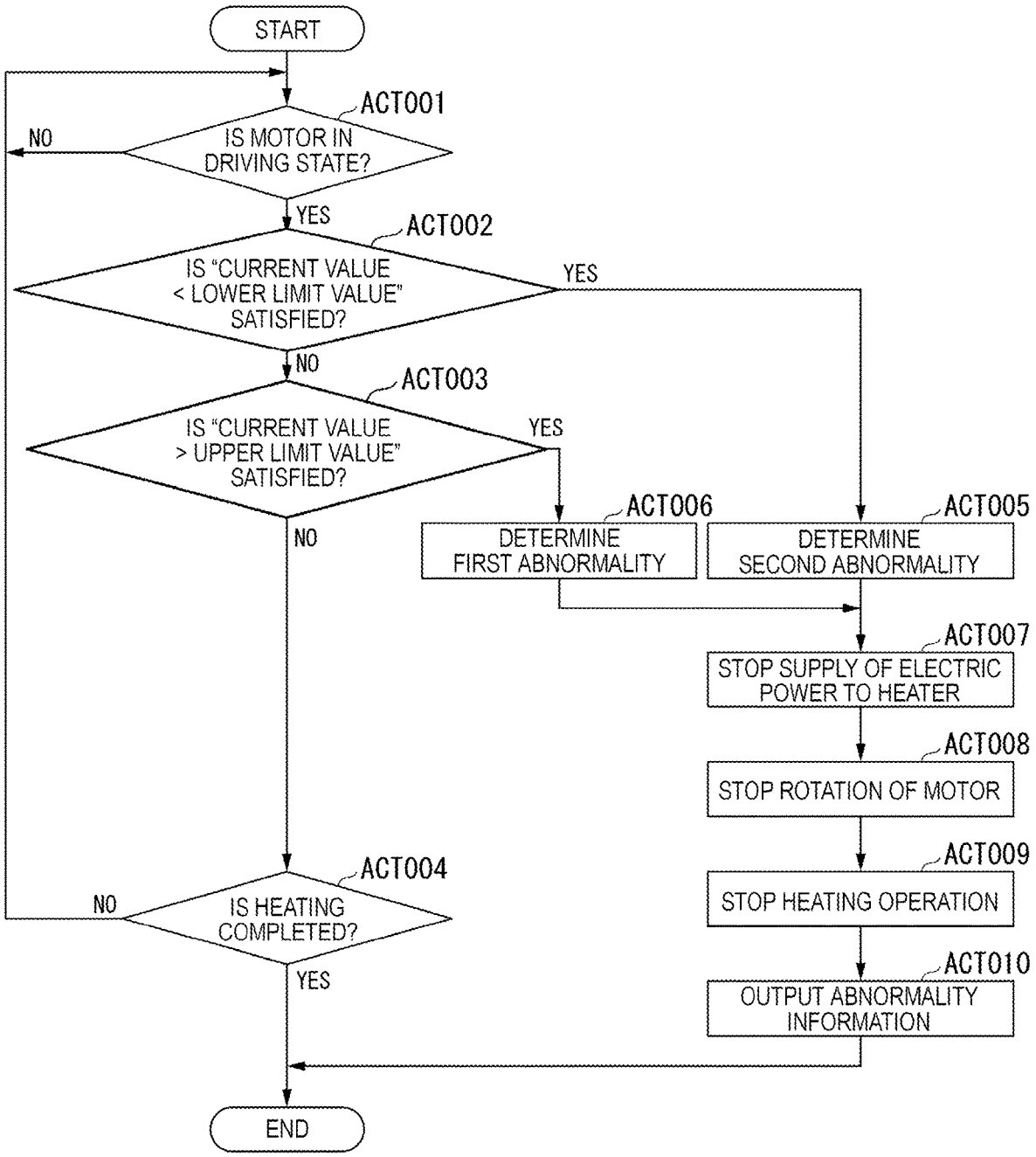
FIG. 10 is a flowchart illustrating aspects of an operation of a heating device in abnormality detection processing.

FIG. 10 is a flowchart illustrating the operation of the fixing device 30 in abnormality detection processing. The abnormality detection processing is processing for detecting the first abnormality and the second abnormality described above, in which there is a possibility that a rapid temperature rise occurs in the heating section having a concern about damaging the heating system.

The control section 6 measures whether or not the motor 70 is in a driving state (that is, a state where the fixing device 30 executes the heating processing) (ACT 001). When the motor 70 is not in a driving state (ACT 001—No), the control section 6 waits until the fixing device 30 is in a state of executing the heating processing by an external instruction.

When the motor 70 is in a driving state (ACT 001—Yes), the control section 6 acquires the information indicating the measurement result of the driving current of the motor 70, which was output from the current sensor 72. The control section 6 compares the value based on the current value of the driving current of the motor 70 based on the acquired information with the lower limit value stored in advance in the memory 92 (ACT 002).

When the value based on the current value of the driving current of the motor 70 based on the acquired information is equal to or greater than the lower limit value stored in advance in the memory 92 (ACT 002—No), the control section 6 performs the processing of ACT 003. The control section 6 compares the value based on the current value of the driving current of the motor 70 based on the acquired information with the upper limit value stored in advance in the memory 92 (ACT 003).

When the value based on the current value of the driving current of the motor 70 based on the acquired information is equal to or less than the upper limit value stored in advance in the memory 92 (ACT 003—No), the control section 6 performs the processing of ACT 004. The control section 6 detects whether or not the heating processing by the fixing device 30 is completed (ACT 004).

When the heating processing is completed (ACT 004—Yes), the operation in the heating processing of the fixing device 30 illustrated by the flowchart in FIG. 10 is completed. Meanwhile, when the heating processing is still continuing (ACT 004—No), the fixing device 30 returns to the processing of ACT 001 again and repeats the above-described series of processing.

In the processing of ACT 002, when the value based on the current value of the driving current of the motor 70 based on the acquired information is a value less than the lower limit value stored in the memory 92 (ACT 002—Yes), the control section 6 performs the processing of ACT 005. The control section 6 determines that the abnormality (second abnormality) occurred in which the rotation of the tubular film 35 stops due to poor abutment between the tubular film 35 and the pressure roller 30-1 (ACT 005).

In the processing of ACT 003, when the value based on the current value of the driving current of the motor 70 based on the acquired information is a value greater than the upper limit value stored in the memory 92 (ACT 003—Yes), the control section 6 performs the processing of ACT 006. The control section 6 determines that the abnormality (first abnormality) occurred in which the rotation of the tubular film 35 stops due to a decrease in residual amount of lubricant (ACT 006).

When it is determined that the first abnormality or the second abnormality occurred, the control section 6 controls the power source 95 to stop the supply of electric power to the heater unit 40 (heating element group 45) (ACT 007). Accordingly, the heating of the tubular film 35 stops. A case where the control section 6 determines that the first abnormality or the second abnormality occurred is a case where the value based on the current value indicated by the measurement result of the driving current of the motor 70 output from the current sensor 72 is out of the predetermined range. The predetermined range here is between the lower limit value and the upper limit value for the value based on the driving current of the motor 70, which can be stored in advance in the memory 92 as described above.

The control section 6 further controls the power source 95 to stop the supply of electric power to the motor 70. Accordingly, the rotation operation of the motor 70 stops (ACT 008). The heating processing by the fixing device 30 also stops (ACT 009).

The control section 6 outputs information indicating the abnormality (ACT 010). For example, the control section 6 controls the control panel 8 and displays the information indicating the abnormality on a display section (for example, a touch panel) provided in or with the control panel 8.

The operation in the heating processing of the fixing device 30 illustrated in the flowchart in FIG. 10 is thus completed.

The fixing devices 30 and 300 of the first embodiment measure the present value of the driving current of the motor 70 that rotationally drives the pressure roller 30-1. When the measured current value is out of the predetermined range, the fixing devices 30 and 300 determine that an abnormality occurred and stop the heating by the heater unit 40.

With this configuration, the fixing device 30 can prevent a rapid temperature rise in the vicinity of the heater unit 40 caused by the rotation stop or rotational speed decrease of the tubular film 35. Accordingly, the fixing devices 30 and 300 (heating device) in the first embodiment can prevent the damage to the equipment caused by a rapid temperature rise in the vicinity of the heater unit 40 (heating section).

The abnormality here refers to the abnormality in which the tubular film 35 stops rotating, or the abnormality in which the rotational speed of the tubular film 35 decreases. As described above, the current value of the driving current of the motor 70 correlates with the driving torque of the motor 70, and thus, the fixing devices 30 and 300 can estimate the occurrence of an abnormality based on the value based on the current value. The fixing devices 30 and 300 compare the value based on the measured current value with the predetermined upper limit value and lower limit value. Accordingly, the fixing devices 30 and 300 detect both the first abnormality, which is an abnormality in which the value based on the current value exceeds the upper limit value, and the second abnormality which is an abnormality in which the value based on the current value is below the lower limit value.

In this example, the control section 6 is configured to stop the supply of electric power to the heater unit 40 when the value based on the driving current of the motor 70 as measured by the current sensor 72 is out of the predetermined range. However, the control section 6 is not limited to this and may be configured, for example, to stop the supply of electric power to the heater unit 40 when the value based on the motor current value is outside of the predetermined range continues for more than some predetermined time period. In such a case, the predetermined time period may be set to, for example, 1 to 2 seconds.

With this configuration, when the driving current changes only momentarily (fluctuates) for some reason (e.g., noise), the control section 6 does not necessarily stop the heating of the tubular film 35 by the heater unit 40 immediately. Accordingly, a false detection of abnormality is avoided.

In other examples, the control section 6 may be configured to stop the supply of electric power to the heater unit 40 when the difference between the value based on the current value of the driving current of the motor 70 measured by the current sensor 72 and the value based on the current value at normal times is greater than a predetermined value. In this case, the value based on the current value at normal times is stored in advance in the memory 92, for example. In this case, as a value based on the current value at normal times, for example, the average value of the values based on the current value in the most recent predetermined period may be set. This is because, in general, the current value at normal times is not always constant, but can change gradually. For example, as the residual amount of lubricant gradually decreases, the load torque in the motor 70 gradually increases. Accordingly, the current value at normal times of the driving current of the motor 70 gradually increases with the passage of time.

In addition to the above-described configuration in which the heating processing is stopped based on the value based on the current value of the driving current of the motor 70, the fixing devices 30 and 300 may further include the following configuration. The fixing devices 30 and 300 may further include a configuration in which the heating processing is stopped even when the temperature of the tubular film 35 or the heater unit 40 exceeds a predetermined upper limit temperature.

Second Embodiment

The fixing devices 30 and 300 of the first embodiment are configured to stop the heating processing based on the driving current of the motor 70. In a second embodiment, a fixing device 30 is configured to stop the heating processing when the temperature of the tubular film 35 exceeds a predetermined upper limit temperature. Furthermore, the heating device in the second embodiment measures the present driving current of the motor 70. When the measured current value is out of the predetermined range, the fixing device 30 of the second embodiment changes the setting of the upper limit temperature from a first upper limit temperature to a second upper limit temperature, which is a lower temperature than the first upper limit temperature.

The image processing apparatus in the second embodiment is the image forming apparatus 1, and the heating device is the fixing device 30. The schematic configuration and the hardware configuration of the image forming apparatus 1 in the second embodiment are the same as the configuration of the image forming apparatus 1 in the first embodiment described with reference to FIGS. 1 to 2, and thus, the description thereof will be omitted. The configuration of the fixing device 30 in the second embodiment is the same as that of the fixing device 30 in the first embodiment described with reference to FIGS. 3 to 8, except for the configuration related to heating control, and thus, the description thereof will be omitted.

Figure 11:
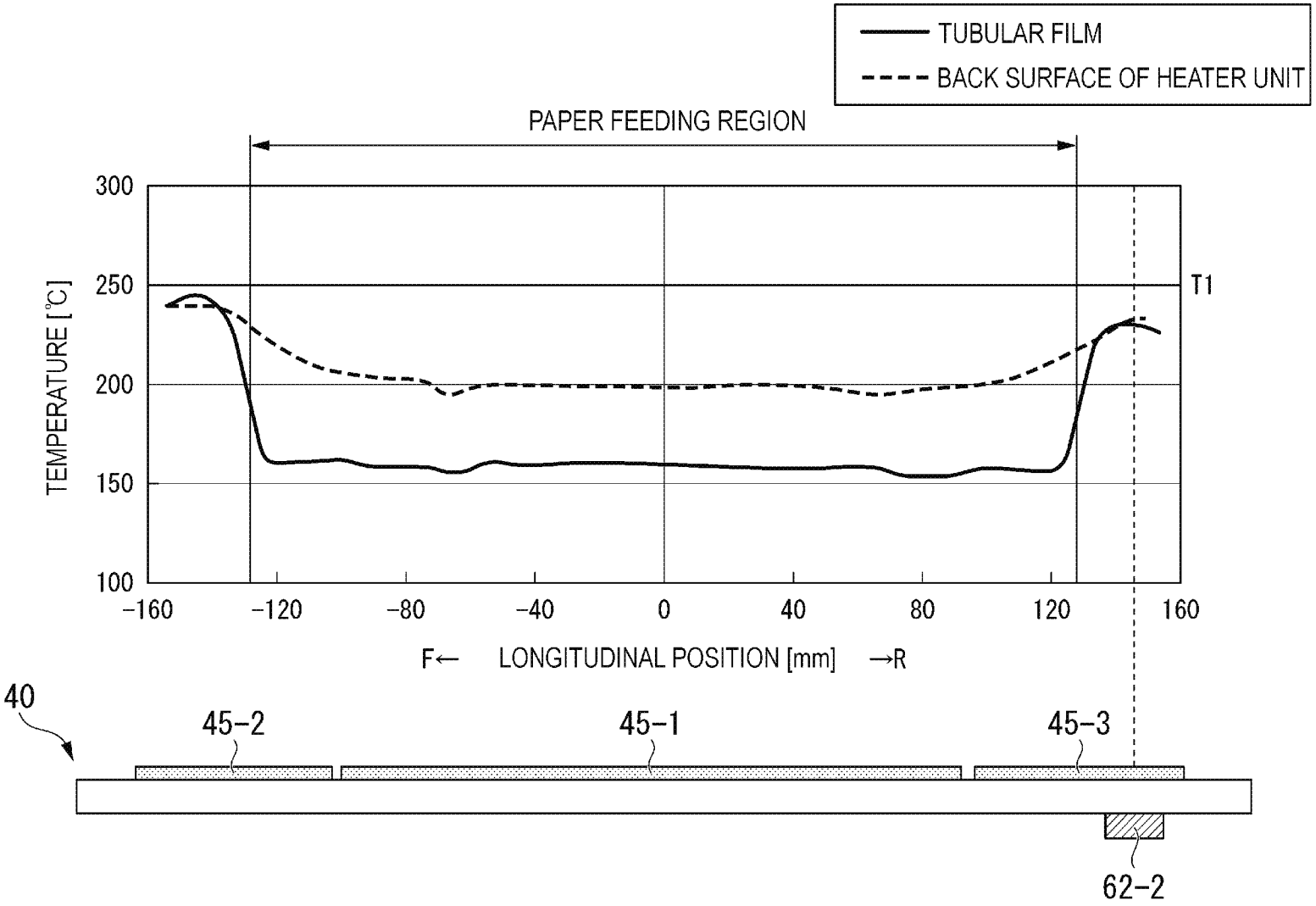
FIG. 11 depicts a temperature distribution of certain portions of a heating device in an example of a second embodiment.

FIG. 11 is a view illustrating an example of temperature distribution when the sheet S is continuously fed to the fixing device 30 in this embodiment. FIG. 11 illustrates an example of the temperature distribution in the longitudinal direction of the tubular film 35 and the temperature distribution in the longitudinal direction of the surface of the heater unit 40 that is not in contact with the tubular film 35. The surface of the heater unit 40 that is not in contact with the tubular film 35 is the surface where the center heater thermometer 62-1 and the end heater thermometer 62-2 are disposed.

FIG. 11 illustrates an example where B5-sized paper is used as the sheet S to be fed. The area out of the paper feeding region in the tubular film 35 is not in contact with the sheet S. Therefore, as illustrated in FIG. 11, the heat in the area out of the paper feeding region in the tubular film 35 is not taken away by the sheet S. Accordingly, the temperature outside the paper feeding region generally tends to be higher than the temperature inside the paper feeding region.

In the fixing device 30 of the second embodiment, the end heater thermometer 62-2 is disposed outside the paper feeding region. The fixing device 30 stops supplying electric power to the heater unit 40 when the temperature of the tubular film 35 exceeds an upper limit temperature T1, in order to prevent abnormal temperature rise due to the heating processing of the heater unit 40. The upper limit temperature is preset to a temperature within the area where the damage of components of the fixing device 30 due to temperature rise does not occur. In the example illustrated in FIG. 11, the upper limit temperature T1 is set to 250[° C.].

When the tubular film 35 stops rotating, the measured temperature of the center heater thermometer 62-1 and the end heater thermometer 62-2 rises rapidly. This is because, as described above, the paper feeding of the sheet S is not performed due to the stop of rotation of the tubular film 35, and the heat is not taken away by the sheet S. When the temperature in the vicinity of the heating area rises abnormally due to the heating processing by the heater unit 40, there is a possibility that the components, for example, the film unit 30-2 and the pressure roller 30-1 are damaged. As described above, factors that cause the tubular film 35 to stop rotating include depletion of lubricant inside the tubular film 35, poor abutment between the tubular film 35 and the pressure roller 30-1, or the like.

Figure 12:
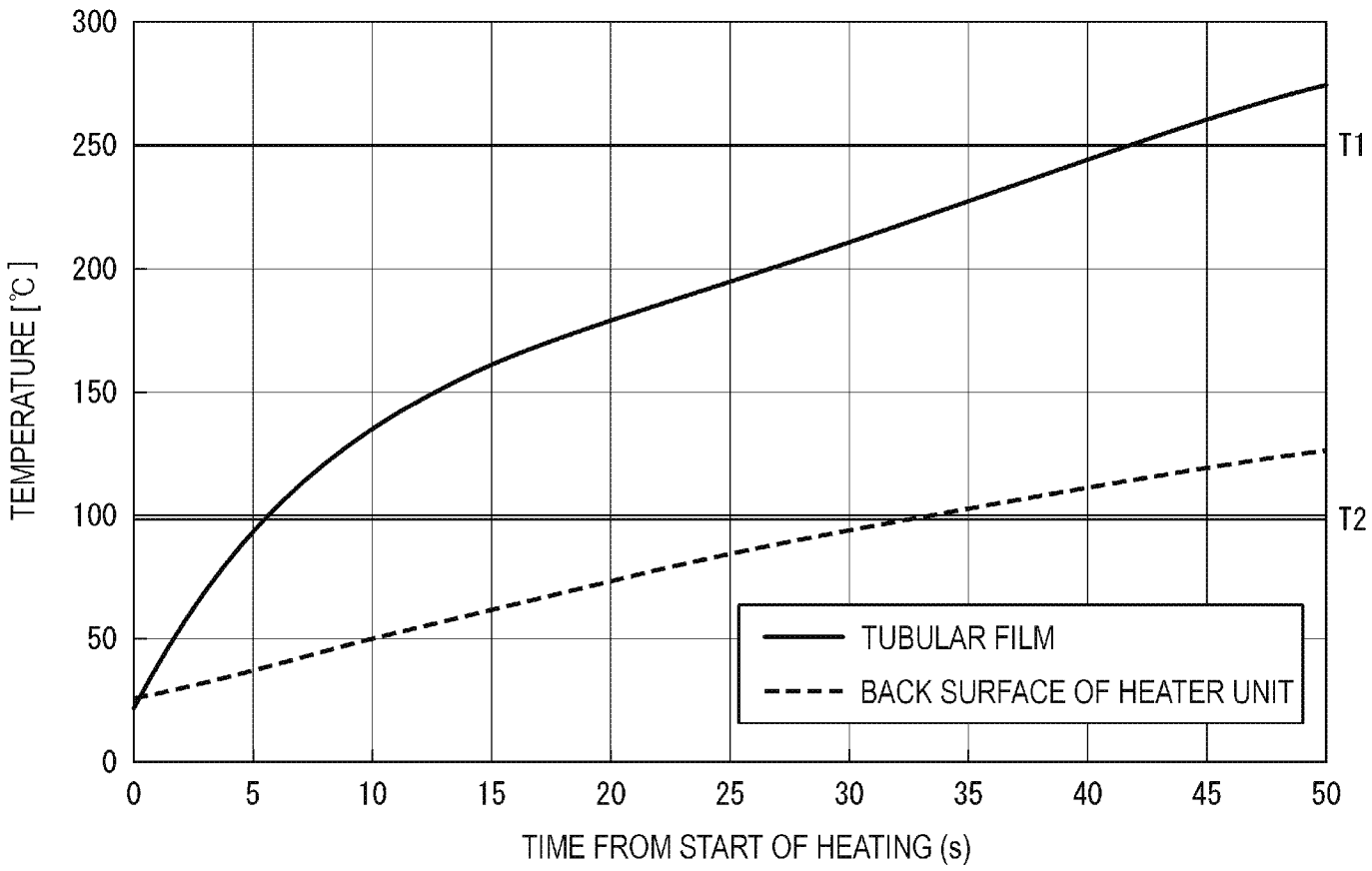
FIG. 12 depicts changes in temperature during a startup transition period.

FIG. 12 is a view illustrating an example of temperature transition when the heating processing is performed by the heater unit 40 in a state where the tubular film 35 does not rotate from the room temperature state. FIG. 12 illustrates the temperature transition of the tubular film 35 and the temperature transition of the end heater thermometer 62-2. The end heater thermometer 62-2 is disposed on the surface of the heater unit 40 that is not in contact with the tubular film 35. The surface of the heater unit 40 that is not in contact with the tubular film 35 is the opposite surface of the heating element group 45 in this embodiment. Hereinafter, the surface of the heater unit 40 that is not in contact with the tubular film 35 is referred to as "heater unit back surface".

Therefore, the temperature rise (that is, the temperature rise of the heater unit back surface) of the end heater thermometer 62-2 will be slower than the temperature rise of the tubular film 35. Accordingly, before the temperature of the heater unit back surface reaches the upper limit temperature T1, the temperature of the tubular film 35 will have already exceeded the upper limit temperature T1. Therefore, in a configuration in which the heating processing is stopped when the temperature of the end heater thermometer 62-2 reaches the upper limit temperature T1, there is a possibility that a component will be damaged. Thus, it is necessary to stop the heating processing before the temperature of the end heater thermometer 62-2 reaches the upper limit temperature T1.

The fixing device 30 in the second embodiment changes the setting of the preset upper limit temperature (upper limit temperature T1) to a lower upper limit temperature (upper limit temperature T2) when the driving current of the motor 70 is out of the predetermined range. When the driving current of the motor 70 is out of the predetermined range, it can be assumed that the tubular film 35 stopped rotating. When the tubular film 35 stops rotating, there is a concern that the temperature of the tubular film 35 will rise rapidly. Therefore, the fixing device 30 of an embodiment makes it possible to stop the heating by the heater unit 40 before a component is damaged by changing the upper limit temperature to a lower temperature as described above.

The heating control by a heating device (e.g., fixing device 30) in the second embodiment will be more specifically described below.

Figure 13:
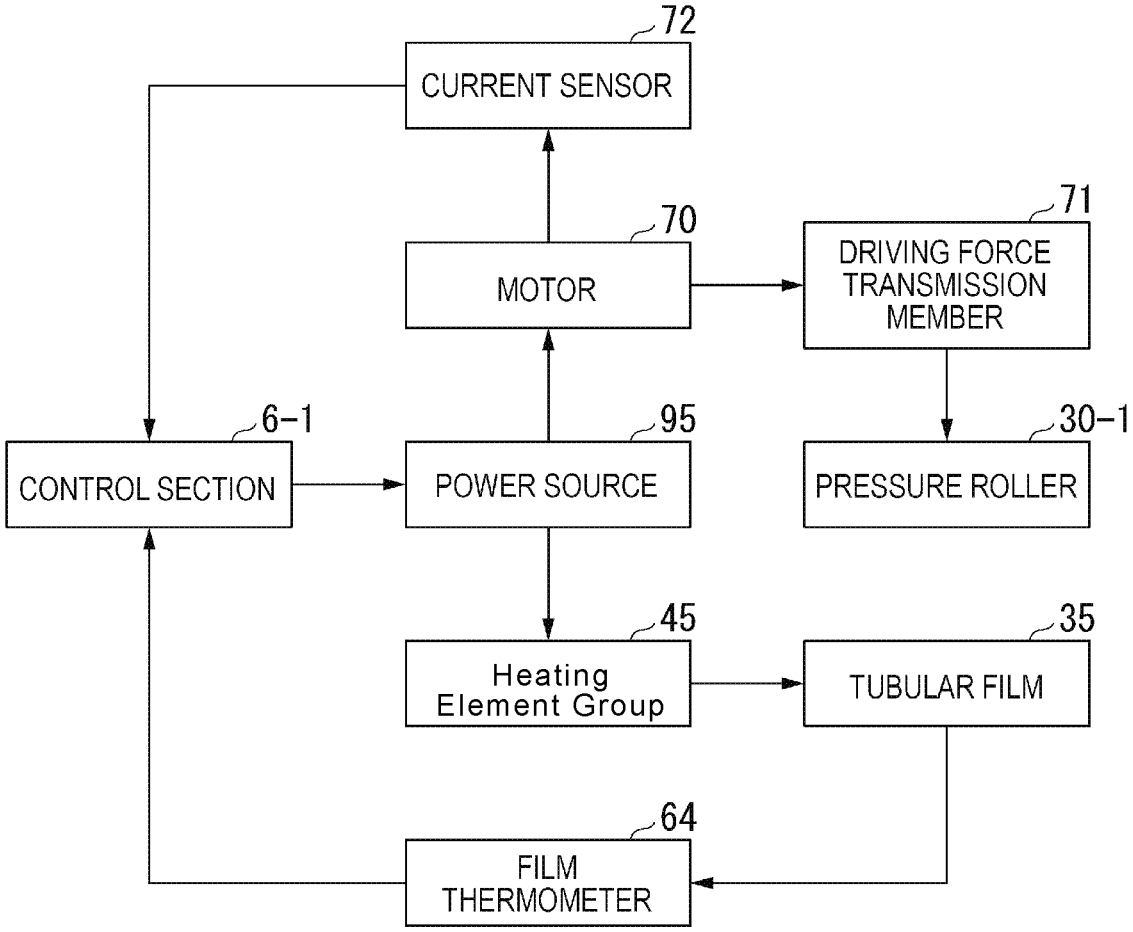
FIG. 13 is a block diagram depicting certain hardware components a of the heating device related heating control.

FIG. 13 is a block diagram excerpting the main components of the heating device used in the heating control described below.

The power source 95 supplies electric power to the heating element group 45.

The heating element group 45 heats the tubular film 35.

The power source 95 supplies electric power to the motor 70. The power generated by the motor 70, to which the electric power was supplied, is transmitted to the driving force transmission member 71. The driving force transmission member 71 is, for example, a driving gear.

The driving force transmission member 71 converts the power transmitted from the motor 70 into a rotating force that rotates the pressure roller 30-1, and rotates the pressure roller 30-1.

The pressure roller 30-1 is given a rotating force from the driving force transmission member 71 and is rotationally driven at a predetermined speed in a clockwise direction, for example.

The tubular film 35 abuts against the pressure roller 30-1. In the nip N formed by the contact between the tubular film 35 and the pressure roller 30-1, a frictional force works as the pressure roller 30-1 is rotationally driven. The frictional force in the nip N causes a rotating force to act on the tubular film 35. For example, the pressure of the pressure spring may be set such that the pressing force between the tubular film 35 and the pressure roller 30-1 is 300 to 500 N in total pressure.

The current sensor 72 measures the driving current of the motor 70. The current sensor 72 measures the driving current, for example, on the base or control board of the motor 70. The current sensor 72 outputs information indicating the measurement result to the control section 6. The measurement result is, for example, the current value of the driving current.

A control section 6-1 acquires the information indicating the measurement result of the driving current in the motor 70, which was output from the current sensor 72. The control section 6-1 (memory 92) may temporarily store the acquired information.

The current value of the driving current of the motor 70 is correlated with the driving torque of the motor 70. Accordingly, the control section 6-1 can estimate the driving torque of the motor 70 from the current value of the driving current.

When the heating element group 45 is heating the tubular film 35, and the rotation of the tubular film 35 stops, the temperature in the vicinity of the heating element group 45 rises rapidly. This is due to the fact that the sheet S is not fed between the tubular film 35 and the pressure roller 30-1 due to the stop of rotation of the tubular film 35, and the heat is no longer taken away by the sheet S. The rotation of the tubular film 35 stops mainly due to a decrease in residual amount of lubricant or poor abutment between the tubular film 35 and the pressure roller 30-1. When the temperature in the vicinity of the heating element group 45 rises rapidly, there is a case where the tubular film 35 or the like is damaged.

When the rotation of the tubular film 35 stops due to a decrease in residual amount of lubricant, the driving torque of the motor 70 becomes greater than that at normal times.

Accordingly, the current value of the driving current measured by the current sensor 72 is greater than that at normal times.

Meanwhile, when the rotation of the tubular film 35 stops due to poor abutment between the tubular film 35 and the pressure roller 30-1, the driving torque of the motor 70 becomes less than that at normal times. Accordingly, the current value of the driving current measured by the current sensor 72 is less than that at normal times.

The film thermometer 64 comes into contact with the inner peripheral surface of the tubular film 35 and measures the temperature of the tubular film 35. The film thermometer 64 outputs information indicating the measurement result to the control section 6-1.

The control section 6-1 acquires the information indicating the temperature of the tubular film 35 output from the film thermometer 64. The control section 6-1 (memory 92) may temporarily store the acquired information.

The control section 6-1 (memory 92) stores the upper limit temperature set to prevent abnormal heating in the heater unit 40. For example, the upper limit temperature T1 is preset as the upper limit temperature at normal times. The control section 6-1 compares the temperature of the tubular film 35 measured by the film thermometer 64 with the upper limit temperature. When the temperature of the tubular film 35 exceeds the upper limit temperature, the control section 6-1 controls the power source 95 to stop the supply of electric power to the heating element group 45. Accordingly, the heating of the tubular film 35 stops. In this case, the control section 6-1 may control the power source 95 to further stop the supply of electric power to the motor 70.

The control section 6-1 (memory 92) stores in advance a threshold value (upper limit value of the value based on the current value of the driving current) for determining that the rotation of the tubular film 35 stopped due to a decrease in residual amount (first abnormality) of lubricant. The control section 6 (memory 92) stores in advance a threshold value (lower limit value of the value based on the current value of the driving current) for determining that the rotation of the tubular film 35 stopped due to poor abutment (second abnormality) between the tubular film 35 and the pressure roller 30-1.

When the value based on the current value indicated by the measurement result of the driving current output from the current sensor 72 is out of the predetermined range, the control section 6-1 changes the setting of the upper limit temperature from the upper limit temperature T1, which is the upper limit temperature at normal times, to the upper limit temperature T2, which is the upper limit temperature for abnormal times.

As illustrated in FIG. 12, the upper limit temperature T2 is set to approximately 100° C., for example. For example, as illustrated in FIG. 12, the upper limit temperature T2 is set to be lower than the temperature (approximately 120° C. in FIG. 12) of the heater unit back surface when the temperature of the tubular film 35 reaches the upper limit temperature T1. The time point when the temperature of the tubular film 35 reaches the upper limit temperature T1 is, in other words, the time point when the temperature at which the component can be damaged is reached.

Hereinafter, an example of the operation of the fixing device 30 in the second embodiment will be described.

Figure 14:
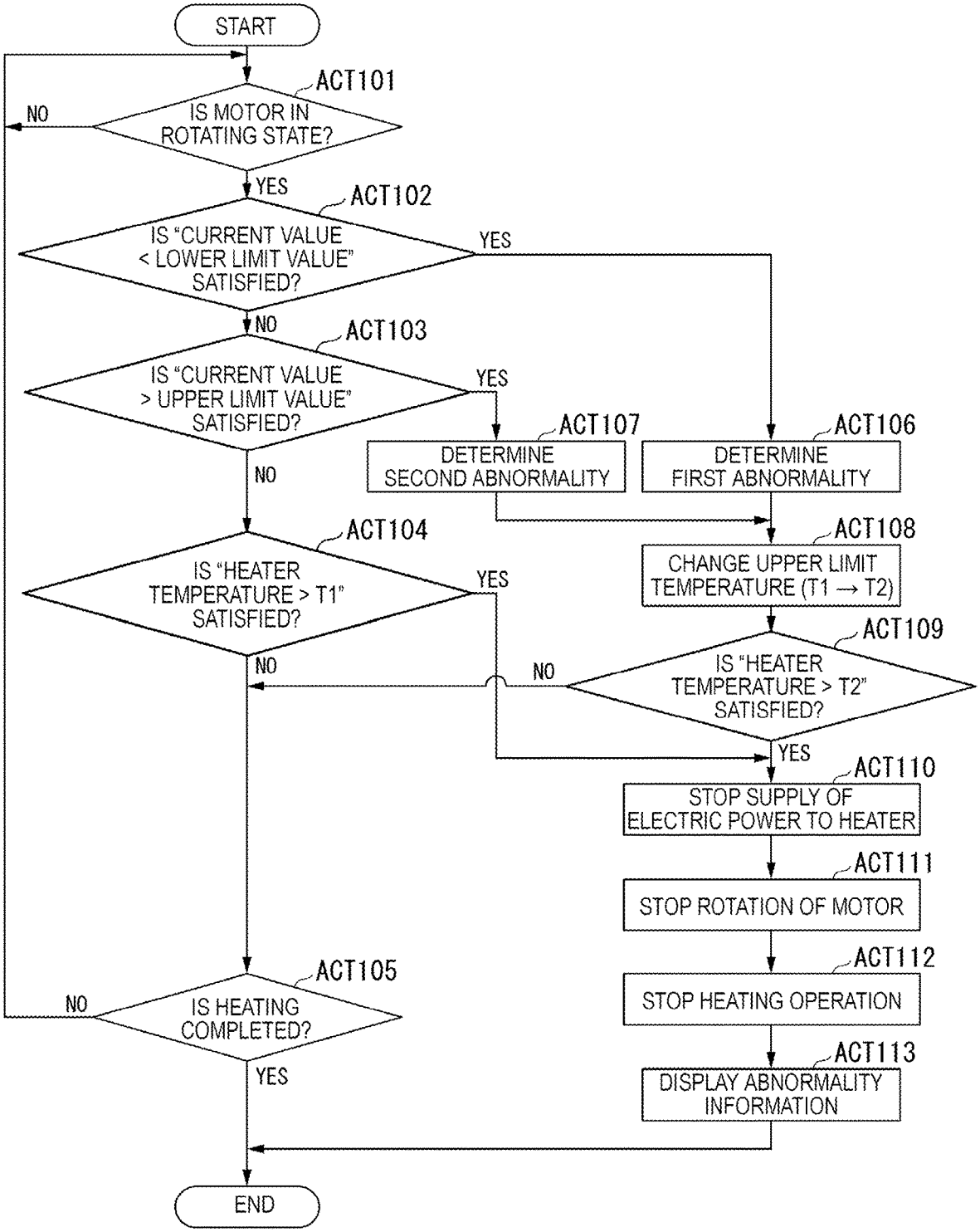
FIG. 14 is a flowchart illustrating aspects of an operation of a heating device in abnormality detection processing.

FIG. 14 is a flowchart illustrating the operation of the fixing device in abnormality detection processing. The abnormality detection processing is processing for detecting the first abnormality and the second abnormality described above, in which there is a possibility that a rapid temperature rise occurs in the heating section having a concern about damaging the heating system.

The control section 6-1 detects whether or not the motor 70 is in a driving state (that is, a state where the fixing device 30 executes the heating processing) (ACT 101). When the motor 70 is not in a driving state (ACT 001—No), the control section 6-1 waits until the fixing device 30 is in a state of executing the heating processing by an external instruction.

When the motor 70 is in a driving state (ACT 101—Yes), the control section 6-1 acquires the information indicating the measurement result of the driving current of the motor 70, which was output from the current sensor 72. The control section 6-1 compares the value based on the current value of the driving current of the motor 70 based on the acquired information with the lower limit value stored in advance in the memory 92 (ACT 102).

When the value based on the current value of the driving current of the motor 70 based on the acquired information is a value which is equal to or greater than the lower limit value of the value based on the current value of the driving current stored in advance in the memory 92 (ACT 102—No), the control section 6-1 performs the processing of ACT 103. The control section 6 compares the value based on the current value of the driving current of the motor 70 based on the acquired information with the upper limit value stored in advance in the memory 92 (ACT 103).

When the value based on the current value of the driving current of the motor 70 based on the acquired information is a value which is equal to or less than the upper limit value stored in advance in the memory 92 (ACT 103—No), the control section 6-1 acquires information indicating the temperature of the tubular film 35, which was output from the film thermometer 64.

When the temperature of the tubular film 35 based on the acquired information is a value which is equal to or less than the upper limit temperature T1 stored in advance in the memory 92 (ACT 104—No), the control section 6-1 detects whether or not the heating processing is completed (ACT 105). When the heating processing is completed (ACT 105—Yes), the operation in the heating processing of the fixing device 30 illustrated by the flowchart in FIG. 14 is completed. When the heating processing is still continuing (ACT 105—No), the fixing device 30 returns to the processing of ACT 101 again and repeats the above-described series of processing.

In the processing of ACT 102, when the value based on the current value of the driving current of the motor 70 based on the acquired information is a value less than the lower limit value stored in advance in the memory 92 (ACT 102—Yes), the control section 6-1 performs the processing of ACT 006. The control section 6-1 determines that an abnormality (a first abnormality) occurred in which the rotation of the tubular film 35 stopped due to poor abutment between the tubular film 35 and the pressure roller 30-1 (ACT 106).

In the processing of ACT 103, when the value based on the current value of the driving current based on the acquired information is a value which is greater than the upper limit value of the value based on the current value of the driving current stored in advance in the memory 92 (ACT 103—Yes), the control section 6-1 performs the processing of ACT 107. The control section 6-1 determines that an abnormality (a second abnormality) occurred in which the rotation of the tubular film 35 stopped due to a decrease in the remaining amount of lubricant (ACT 107).

When it is determined that the first abnormality or the second abnormality occurred, the control section 6-1 changes the setting of the upper limit temperature from the preset upper limit temperature T1 at normal times to the upper limit temperature T2 at abnormal times (ACT 108). As described above, the upper limit temperature T2 is lower than the upper limit temperature T1.

The control section 6-1 acquires the information indicating the temperature of the tubular film 35 output from the film thermometer 64.

When the temperature of the tubular film 35 based on the acquired information is a value which is equal to or less than the upper limit temperature T2 (ACT 109—No), the control section 6-1 detects whether or not the heating processing is completed (ACT 105). When the heating processing is completed (ACT 105—Yes), the operation in the heating processing of the fixing device 30 illustrated by the flowchart in FIG. 14 is completed. When the heating processing is still continuing (ACT 105—No), the fixing device 30 returns to the processing of ACT 101 again and repeats the above-described series of processing.

In the processing of ACT 104, when the temperature of the tubular film 35 based on the acquired information is a value which is higher than the upper limit temperature T1 stored in advance in the memory 92 (ACT 104—No), the control section 6-1 performs the processing of ACT 110. The control section 6-1 controls the power source 95 to stop the supply of electric power to the heater unit 40 (ACT 110). Accordingly, the heating of the tubular film 35 stops. A case where the control section 6-1 determines that the first abnormality or the second abnormality occurred is a case where the value based on the current value indicated by the measurement result of the driving current of the motor 70 output from the current sensor 72 is out of the predetermined range. The predetermined range here is from the lower limit value to the upper limit value of the value based on the driving current of the motor 70, which is stored in advance in the memory 92.

The control section 6-1 further controls the power source 95 to stop the supply of electric power to the motor 70. Accordingly, the rotation operation of the motor 70 stops (ACT 111). As described above, the heating operation by the fixing device 30 stops (ACT 112).

The control section 6-1 outputs the information indicating the abnormality (ACT 113). For example, the control section 6-1 controls the control panel 8 and displays the information indicating the abnormality on a display section (for example, touch panel) provided in or with the control panel 8.

Above, the operation in the heating processing of the fixing device 30 illustrated in the flowchart in FIG. 14 is completed.

In the processing of the ACT 104, when the temperature of the tubular film 35 based on the acquired information is a value which is higher than the upper limit temperature T1 stored in advance in the memory 92 (ACT 104—No), the control section 6-1 performs the processing of ACT 110. The control section 6-1 controls the power source 95 to stop the supply of electric power to the heater unit 40 (ACT 110). Accordingly, the heating of the tubular film 35 stops.

The control section 6-1 further controls the power source 95 to stop the supply of electric power to the motor 70. Accordingly, the rotation operation of the motor 70 stops (ACT 111). As described above, the heating operation by the fixing device 30 stops (ACT 112).

The control section 6-1 outputs the information indicating the abnormality (ACT 113). For example, the control section 6-1 controls the control panel 8 and outputs the information indicating that the temperature of the tubular film 35 exceeds the upper limit temperature T1 at normal times, to the display section (for example, touch panel) provided in or with the control panel 8.

Above, the operation in the heating processing of the fixing device 30 illustrated in the flowchart in FIG. 14 is completed.

As described above, the fixing device 30 (heating device) in the second embodiment measures the temperature of the tubular film 35. The fixing device 30 compares the measured temperature of the tubular film 35 with the upper limit temperature. When the temperature of the tubular film 35 exceeds the upper limit temperature, the fixing device 30 stops the heating processing to the tubular film 35 by the heater unit 40.

The fixing device 30 also measures the current value of the driving current of the motor 70 that rotationally drives the pressure roller 30-1. When the value based on the measured current value is out of the predetermined range, the fixing devices 30 and 300 determine that an abnormality occurred and change the upper limit temperature setting from the upper limit temperature T1 for normal times to the upper limit temperature T2 for abnormal times. The upper limit temperature T2 is lower than the upper limit temperature T1.

With this configuration, the fixing device 30 in the second embodiment can prevent a rapid temperature rise in the vicinity of the heater unit 40 caused by a rotation stop or rotational speed decrease of the tubular film 35. Accordingly, the fixing device 30 in the second embodiment can prevent damage to the equipment that might otherwise be caused by a rapid temperature increase in the vicinity of the heater unit 40.

In the second embodiment, the control section 6-1 is configured to change the setting of the upper limit temperature from the upper limit temperature T1 to the upper limit temperature T2, either when it is determined that a first abnormality occurred or when it is determined that a second abnormality occurred. However, the present disclosure is not limited to this. For example, the control section 6-1 may change the upper limit temperature T1 to the upper limit temperature T2 when it is determined that the first abnormality occurred, and/or change the upper limit temperature T1 to an upper limit temperature T3 when it is determined that the second abnormality occurred.

In such a case, the upper limit temperature T2 may be set to be lower than the upper limit temperature T3. This is because the temperature of the heater unit 40 is expected to rise more rapidly when the first abnormality occurred than when the second abnormality occurred. As described above, the first abnormality is an abnormality in which the rotation of the tubular film 35 stops due to poor abutment between the tubular film 35 and the pressure roller 30-1. As described above, the second abnormality is an abnormality in which the rotation of the tubular film 35 stops due to deterioration of slidability (increased friction) due to a decrease in the remaining amount of lubricant.

In the second embodiment, the control section 6-1 is configured to stop the supply of electric power to the heater unit 40 when the temperature measured by the film thermometer 64 exceeds the upper limit temperature. However, not being limited to this configuration, for example, the control section 6-1 may be configured to stop the supply of electric power to the heater unit 40 when the temperature rise rate measured by the film thermometer 64 exceeds a predetermined rise rate (threshold value). In this case, for example, when the value based on the driving current is out of the predetermined range, the control section 6-1 may change the setting of the predetermined rise rate value (threshold value) to a lower value.

In the first embodiment and the second embodiment, the heating element group 45 includes three heating elements (the center heating element 45-1, the first end heating element 45-2, and the second end heating element 45-3). However, the number of heating elements included in the heating element group 45 may be one or two, or even four or more.

In the first embodiment and the second embodiment, the plurality of heater thermometers 62 include two heater thermometers (the center heater thermometer 62-1 and the end heater thermometer 62-2). However, the number of heater thermometers 62 may be three or more.

In the first embodiment and the second embodiment, the plurality of thermostats 68 include two thermostats (the center thermostat 68-1 and the end thermostat 68-2). However, the number of thermostats 68 may be three or more.

A heating element in the heating element group 45 may be a heating element having positive temperature resistance characteristics.

The image processing apparatus in the first embodiment and the second embodiment may be a decoloring device. In this case, the heating device is a decoloring section. The decoloring device decolors (erases) an image previously formed on the sheet using a decolorable toner. The decoloring section heats and decolors the decolorable toner image previously formed on the sheet.

Some or the entire functions of the image forming apparatus 1 may be realized by using hardware such as an application specific integrated circuit (ASIC), a programmable logic device (PLD), a field programmable gate array (FPGA) or the like. The program may be recorded on a non-transitory computer-readable recording medium. The non-transitory computer-readable recording medium can be a portable medium such as a flexible disk, a magneto-optical disk, a ROM, and a CD-ROM, and a storage device such as a hard disk embedded in a computer system. The program may be transmitted via telecommunication lines.

In the first embodiment and the second embodiment, the control section 6-1 is assumed to be configures via software, but in other examples, the control section 6-1 (or some or all functions thereof) may be implemented as dedicated hardware circuits such as an LSI circuit or the like.

According certain above-described embodiments, the heating device includes an endless fixing belt, a pressure roller, a heating section, a driving section, a current measuring section, and a controller. For example, the heating device is one of the fixing devices 30 or 300. The endless fixing belt can be the tubular film 35. The pressure roller can be the pressure roller 30-1. The heating section can be heater unit 40, the driving section can be motor 70, the current measuring section can be the current sensor 72, and the controller can be one of the control sections 6 and 6-1.

In general, the fixing belt is supported to be capable of moving in a rotating manner. The pressure roller abuts against an outside of the fixing belt. The heating section heats the fixing belt. The driving section rotates the fixing belt by rotating the pressure roller. The current measuring section measures a driving current in the driving section. The controller stops the heating of the heating section based on a measurement related to the driving current. For example, the measurement related to the driving current is a value based on the current value of the driving current.

The controller may stop the heating of the heating section when a value based on a current value of the driving current is a value out of a predetermined range of values.

The controller may stop the heating when the value based on the driving current value is outside the predetermined range for more than some predetermined period of time.

The heating device may further include a temperature measuring section that measures a temperature of the heating section. The controller may stop the heating of the heating section based on the temperature measured by the temperature measuring section if the value for the driving current is out of the predetermined range.

The controller may lower an upper limit temperature for the heating section from a first upper limit temperature to a second upper limit temperature when the value the driving current is of the predetermined range. In such a case, the controller may stop the heating of the heating section when the temperature measured by the temperature measuring section exceeds the revised upper limit temperature.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A heating device, comprising:

a fixing belt configured to be rotated;

a pressure roller configured to abut against the fixing belt and be driven to cause the fixing belt to rotate;

a heater configured to heat the fixing belt;

a motor configured to drive the pressure roller to rotate;

a current sensor configured to measure a driving current of the motor; and a controller configured to stop heating of the heater when the measured driving current is outside of a predetermined range and also either the measured driving current is outside of the predetermined range for a predetermined time period or a temperature of the heater measured by a temperature sensor exceeds an upper limit temperature.

2. The heating device according to claim 1, wherein the controller is further configured to:

lower the upper limit temperature for the heater from a first upper limit to a second upper limit when the measured driving current is outside of the predetermined range, and stop the heating of the heater whenever the temperature of the heater measured by the temperature sensor exceeds the upper limit temperature.

3. The heating device according to claim 1, wherein the heater comprises a resistive heating element.

4. The heating device according to claim 1, wherein the fixing belt is a cylindrical shape, and the heater is disposed within an interior region formed by the fixing belt to face the pressure roller across the fixing belt.

5. An image forming apparatus, comprising:

a sheet conveyance path; and a heating device configured to receive a sheet from the conveyance path and heat the sheet, the heating device including:

a fixing belt configured to be rotated;

a pressure roller configured to abut against the fixing belt and form a nip through which the sheet passes, the pressure roller being driven to cause the fixing belt to rotate;

a heater configured to heat the fixing belt;

a motor configured to drive the pressure roller to rotate;

a current sensor configured to measure a driving current of the motor; and a controller configured to stop heating of the heater when the measured driving current is outside of a predetermined range and also either the measured driving current is outside of the predetermined range for a predetermined time period or a temperature of the heater measured by a temperature sensor exceeds an upper limit temperature.

6. The image forming apparatus according to claim 5, wherein the controller is further configured to:

lower the upper limit temperature for the heater from a first upper limit to a second upper limit when the measured driving current is outside of the predetermined range, and stop the heating of the heater whenever the temperature of the heater measured by the temperature sensor exceeds the upper limit temperature.

7. The image forming apparatus according to claim 5, wherein the heater comprises a resistive heating element.

8. The image forming apparatus according to claim 5, wherein the fixing belt is a cylindrical shape, and the heater is disposed within an interior region formed by the fixing belt to face the pressure roller across the fixing belt.

9. A heating control method for a fixing device, the method comprising:

rotating a fixing belt by rotating a pressure roller that abuts against the fixing belt with a motor;

heating the fixing belt with a heater; and stopping the heating of the fixing belt by the heater when a measurement of a driving current of the motor during the rotating of the fixing belt is outside of a predetermined range and also either the measured driving current is outside of the predetermined range for a predetermined time period or a temperature of the heater measured by a temperature sensor exceeds an upper limit temperature.

10. The heating control method according to claim 9, further comprising:

lowering the upper limit temperature of the heater from a first temperature to a second temperature when the measured driving current is outside of the predetermined range;

measuring the temperature of the heater; and stopping heating of the fixing belt by the heater whenever the measured temperature of the heater exceeds the upper limit temperature.

11. The heating control method according to claim 9, further comprising:

detecting whether the pressure roller is contacting the fixing belt for purposes of rotation based on the measured driving current.

* * * * *